US007111338B2

(12) United States Patent
Faux et al.

(10) Patent No.: US 7,111,338 B2
(45) Date of Patent: Sep. 26, 2006

(54) APPARATUS FOR PULLING PATIENT UP IN BED

(75) Inventors: John Arnold Faux, Oldenburg, IN (US); Jon C. Tekulve, Milan, IN (US); Troy D. Acton, St. Paul, IN (US); Gary Allen Vandenbark, Markleville, IN (US); Glenn L. Ellis, Indianapolis, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 39 days.

(21) Appl. No.: 10/517,112

(22) PCT Filed: Jun. 13, 2003

(86) PCT No.: PCT/US03/18875

§ 371 (c)(1),
(2), (4) Date: Dec. 3, 2004

(87) PCT Pub. No.: WO03/105743

PCT Pub. Date: Dec. 24, 2003

(65) Prior Publication Data

US 2005/0138727 A1 Jun. 30, 2005

Related U.S. Application Data

(60) Provisional application No. 60/389,212, filed on Jun. 17, 2002.

(51) Int. Cl.
*A61G 7/14* (2006.01)

(52) U.S. Cl. ..... 5/81.1 HS; 5/81.1 C; 5/81.1 R; 5/88.1

(58) Field of Classification Search ..... 5/81.1 R, 5/81.1 C, 81.1 HS, 88.1
See application file for complete search history.

(56) References Cited

U.S. PATENT DOCUMENTS

| | | | | |
|---|---|---|---|---|
| 378,220 | A | | 2/1888 | Staples et al. |
| 716,886 | A | | 12/1902 | Goode |
| 1,085,879 | A | * | 2/1914 | Skeffington ..... 5/88.1 |
| 1,139,526 | A | | 5/1915 | Holicky |
| 1,263,611 | A | | 4/1918 | Scroggin |
| 1,487,171 | A | | 3/1924 | Vigne |
| 1,620,298 | A | | 3/1927 | Smith |
| 1,815,006 | A | | 4/1931 | Horsting et al. |
| 2,093,231 | A | | 9/1937 | Broadwell |
| 2,177,986 | A | | 10/1939 | James |
| 2,291,444 | A | | 7/1942 | Bengtson |
| 2,439,006 | A | | 4/1948 | Vanderlyn et al. |
| 2,498,853 | A | | 2/1950 | Hassold et al. |
| 2,528,048 | A | | 10/1950 | Gilleland |
| 2,536,707 | A | | 1/1951 | Allyn |
| 2,565,761 | A | | 8/1951 | Dean |
| 2,630,583 | A | | 3/1953 | Gilleland |

(Continued)

FOREIGN PATENT DOCUMENTS

| | | |
|---|---|---|
| CH | 660123 | 12/1978 |

(Continued)

*Primary Examiner*—Michael Trettel
(74) *Attorney, Agent, or Firm*—Barnes & Thornburg LLP

(57) ABSTRACT

A patient positioning apparatus (30, 330) is provided for use with a patient-support device (20, 320). The patient positioning apparatus (30, 330) is used to pull a sheet (32, 332) on the patient-support device (20, 320) while a patient is lying on the sheet (32, 332) to position the patient in a desired location on the patient-support device (20, 320).

26 Claims, 17 Drawing Sheets

U.S. PATENT DOCUMENTS

| | | | |
|---|---|---|---|
| 2,632,619 | A | 3/1953 | Wilson |
| 2,665,432 | A | 1/1954 | Butler |
| 2,710,975 | A | 6/1955 | Stoon et al. |
| 2,733,452 | A | 2/1956 | Tanney |
| 2,745,163 | A | 5/1956 | Van Buren, Jr. |
| 2,761,153 | A | 9/1956 | Mew |
| 2,812,524 | A | 11/1957 | Pruitt |
| 2,826,766 | A | 3/1958 | Stoner |
| 2,827,642 | A | 3/1958 | Huff |
| 2,860,352 | A | 11/1958 | Pierre |
| 2,939,195 | A | 6/1960 | Carlson |
| 2,959,412 | A | 11/1960 | Sjostrom |
| 2,959,792 | A | 11/1960 | Haugard |
| 2,979,737 | A | 4/1961 | Pierre |
| 3,099,842 | A | 8/1963 | Jansen |
| 3,108,290 | A | 10/1963 | Partridge |
| 3,154,340 | A | 10/1964 | Lowell |
| 3,167,788 | A | 2/1965 | Murphy et al. |
| 3,167,789 | A | 2/1965 | Wicks |
| 3,259,922 | A | 7/1966 | Fischer |
| 3,294,247 | A | 12/1966 | Norrington |
| 3,302,219 | A | 2/1967 | Harris |
| 3,317,928 | A | 5/1967 | Root |
| 3,363,269 | A | 1/1968 | Kossuth |
| 3,364,506 | A | 1/1968 | Hale |
| 3,383,717 | A | 5/1968 | Underwood |
| 3,392,410 | A | 7/1968 | Grahn |
| 3,413,663 | A | 12/1968 | Swann |
| 3,418,670 | A | 12/1968 | Morgan |
| 3,451,070 | A | 6/1969 | Danielson |
| 3,452,371 | A | 7/1969 | Hirsch |
| 3,506,985 | A | 4/1970 | Lang |
| 3,506,988 | A | 4/1970 | Saddoris |
| 3,521,308 | A | 7/1970 | Fowler et al. |
| 3,562,824 | A | 2/1971 | White |
| 3,593,351 | A | 7/1971 | Dove |
| 3,597,774 | A | 8/1971 | Warren |
| 3,750,199 | A | 8/1973 | Spivey |
| 3,769,642 | A | 11/1973 | Warman |
| 3,775,784 | A | 12/1973 | Fry |
| 3,781,929 | A | 1/1974 | Stevens |
| 3,794,313 | A | 2/1974 | Berger et al. |
| 3,810,263 | A | 5/1974 | Taylor et al. |
| 3,827,089 | A | 8/1974 | Grow |
| 3,829,914 | A | 8/1974 | Treat |
| 3,859,677 | A | 1/1975 | Nordwig |
| 3,874,010 | A | 4/1975 | Geary |
| 3,877,089 | A | 4/1975 | Spivey et al. |
| 3,884,225 | A | 5/1975 | Witter |
| 3,895,403 | A | 7/1975 | Davis |
| 3,905,055 | A | 9/1975 | Blair |
| 3,924,281 | A | 12/1975 | Gibbs |
| 3,938,203 | A | 2/1976 | Linard |
| 4,011,609 | A | 3/1977 | Bethlen |
| 4,012,799 | A | 3/1977 | Rutherford |
| 4,038,572 | A | 7/1977 | Hanagan |
| 4,038,727 | A | 8/1977 | Robbins |
| 4,051,565 | A | 10/1977 | Berge |
| 4,070,721 | A | 1/1978 | Stasko |
| 4,077,073 | A | 3/1978 | Koll et al. |
| 4,092,748 | A | 6/1978 | Ewers |
| 4,125,908 | A | 11/1978 | Vail et al. |
| 4,156,946 | A | 6/1979 | Attenburrow |
| 4,161,044 | A | 7/1979 | Bogle |
| 4,180,879 | A | 1/1980 | Mann |
| 4,194,253 | A | 3/1980 | Ullven |
| 4,195,375 | A | 4/1980 | Paul |
| 4,202,063 | A | 5/1980 | Murray |
| 4,222,132 | A | 9/1980 | Crim et al. |
| 4,259,756 | A | 4/1981 | Pace |
| 4,262,375 | A | 4/1981 | Lilienthal |
| 4,270,234 | A | 6/1981 | James |
| 4,274,168 | A | 6/1981 | Depowski |
| 4,281,564 | A | 8/1981 | Hill |
| 4,296,509 | A | 10/1981 | Simmons et al. |
| 4,327,453 | A | 5/1982 | Sefton |
| 4,361,918 | A | 12/1982 | Roisaeth |
| 4,403,641 | A | 9/1983 | Reeder |
| 4,416,511 | A | 11/1983 | Weinberg |
| 4,459,712 | A | 7/1984 | Pathan |
| 4,479,993 | A | 10/1984 | James |
| 4,490,867 | A | 1/1985 | Gabrielsson |
| 4,498,205 | A | 2/1985 | Hino |
| 4,500,127 | A | 2/1985 | Van Derlin |
| 4,502,169 | A | 3/1985 | Persson |
| 4,536,903 | A | 8/1985 | Parker |
| 4,558,847 | A | 12/1985 | Coates |
| 4,627,122 | A | 12/1986 | Hopp |
| 4,635,308 | A | 1/1987 | Maggio et al. |
| 4,644,595 | A | 2/1987 | Daniel |
| 4,660,240 | A | 4/1987 | Hutton et al. |
| 4,662,016 | A | 5/1987 | Seeman |
| 4,679,259 | A | 7/1987 | DiMatteo et al. |
| 4,680,818 | A | 7/1987 | Ooka et al. |
| 4,681,279 | A | 7/1987 | Nakamura |
| 4,686,748 | A | 8/1987 | Kaivanto |
| 4,688,304 | A | 8/1987 | Marcott |
| 4,698,880 | A | 10/1987 | Hamm |
| 4,700,415 | A | 10/1987 | DiMatteo et al. |
| 4,700,417 | A | 10/1987 | McGovern |
| 4,716,607 | A | 1/1988 | Johansson |
| 4,726,082 | A | 2/1988 | DiMatteo et al. |
| 4,739,526 | A | 4/1988 | Hollick |
| 4,747,170 | A | 5/1988 | Knouse |
| 4,761,841 | A | 8/1988 | Larsen |
| 4,776,047 | A | 10/1988 | DiMatteo |
| 4,782,543 | A | 11/1988 | Hutton et al. |
| 4,787,104 | A | 11/1988 | Grantham |
| 4,794,660 | A | 1/1989 | Hawkrigg |
| 4,796,313 | A | 1/1989 | DiMatteo et al. |
| 4,799,273 | A * | 1/1989 | Elze ..... 5/81.1 C |
| 4,809,377 | A | 3/1989 | Lynn |
| 4,819,283 | A | 4/1989 | DiMatteo et al. |
| 4,821,352 | A | 4/1989 | DiMatteo et al. |
| 4,829,617 | A | 5/1989 | Dameron |
| 4,837,872 | A | 6/1989 | DiMatteo et al. |
| 4,837,873 | A | 6/1989 | DiMatteo et al. |
| 4,840,363 | A | 6/1989 | McConnell |
| 4,843,665 | A | 7/1989 | Cockel et al. |
| 4,850,562 | A | 7/1989 | Mazzanti |
| 4,868,938 | A | 9/1989 | Knouse |
| 4,872,226 | A | 10/1989 | Lonardo |
| 4,887,325 | A | 12/1989 | Tesch |
| 4,908,890 | A | 3/1990 | Beckman et al. |
| 4,918,771 | A | 4/1990 | James |
| 4,920,590 | A | 5/1990 | Weiner |
| 4,937,901 | A | 7/1990 | Brennan |
| 4,937,904 | A | 7/1990 | Ross |
| 4,939,801 | A | 7/1990 | Schaal et al. |
| 4,941,220 | A | 7/1990 | DiMatteo et al. |
| 4,970,738 | A | 11/1990 | Cole |
| 4,987,623 | A | 1/1991 | Stryker et al. |
| 5,001,789 | A | 3/1991 | Schoenberger |
| 5,014,399 | A | 5/1991 | Grisel |
| 5,014,968 | A | 5/1991 | Lammers et al. |
| 5,016,306 | A | 5/1991 | Grivna et al. |
| 5,018,225 | A | 5/1991 | Fergni et al. |
| 5,022,810 | A | 6/1991 | Sherrow et al. |
| 5,033,132 | A | 7/1991 | Greenblatt |
| 5,033,170 | A | 7/1991 | Ewert |
| 5,036,557 | A | 8/1991 | Fales |
| 5,038,424 | A | 8/1991 | Carter et al. |
| 5,046,207 | A | 9/1991 | Chamberlain |
| 5,048,133 | A | 9/1991 | Iura et al. |

5,050,254 A 9/1991 Murphy
5,054,140 A 10/1991 Bingham et al.
5,060,324 A 10/1991 Marinberg et al.
5,063,624 A 11/1991 Smith et al.
5,065,464 A 11/1991 Blanchard et al.
5,068,931 A 12/1991 Smith
5,072,840 A 12/1991 Asakawa et al.
5,083,331 A 1/1992 Schnelle et al.
5,127,113 A 7/1992 Di Matteo et al.
5,144,284 A 9/1992 Hammett
5,148,558 A 9/1992 Dunn
5,161,276 A 11/1992 Hutton et al.
5,163,189 A 11/1992 DeGray
5,168,587 A 12/1992 Shutes
5,172,442 A 12/1992 Bartley et al.
5,197,156 A 3/1993 Stryker et al.
5,210,887 A 5/1993 Kershaw
5,239,713 A 8/1993 Toivio et al.
5,271,110 A 12/1993 Newman
5,274,862 A 1/1994 Palmer, Jr. et al.
5,279,010 A 1/1994 Ferrand et al.
5,280,657 A * 1/1994 Stagg ..... 5/81.1 R
5,285,556 A 2/1994 Shorin et al.
5,319,813 A 6/1994 DiMatteo et al.
5,329,657 A 7/1994 Bartley et al.
5,340,266 A 8/1994 Hodgetts
5,343,581 A 9/1994 Bartley et al.
5,359,739 A 11/1994 Rains et al.
5,377,391 A 1/1995 Foster
5,379,468 A 1/1995 Cassidy et al.
5,390,379 A 2/1995 Palmer, Jr. et al.
5,394,576 A 3/1995 Soltani et al.
5,404,602 A 4/1995 Kondo
5,406,658 A 4/1995 Olkkonen et al.
5,428,851 A 7/1995 Shore et al.
5,456,655 A 10/1995 Morris
5,469,588 A 11/1995 DiMatteo et al.
5,513,406 A 5/1996 Foster et al.
5,522,100 A 6/1996 Schilling et al.
5,524,304 A 6/1996 Shutes
5,530,974 A 7/1996 Rains et al.
5,539,941 A 7/1996 Fuller
5,544,371 A 8/1996 Fuller
5,544,395 A 8/1996 Rosenvinge
5,560,374 A 10/1996 Viard
5,561,878 A 10/1996 Ruehl
5,562,091 A 10/1996 Foster et al.
5,577,279 A 11/1996 Foster et al.
5,608,929 A * 3/1997 Crane ..... 5/81.1 R
5,613,252 A 3/1997 Yu et al.
5,615,425 A 4/1997 Corente
5,615,426 A 4/1997 Hokett
5,630,238 A 5/1997 Weismiller et al.
5,642,537 A 7/1997 Johnson
5,647,079 A 7/1997 Hakamiun et al.
5,651,149 A 7/1997 Garman
5,653,064 A 8/1997 Kappers et al.
5,659,905 A 8/1997 Palmer, Jr. et al.
5,669,089 A 9/1997 Dees
5,673,443 A 10/1997 Marmor
5,680,661 A 10/1997 Foster et al.
5,682,631 A 11/1997 Weismiller et al.
5,692,272 A 12/1997 Woods
5,697,109 A 12/1997 Hodgetts
5,708,997 A 1/1998 Foster et al.
5,715,548 A 2/1998 Weismiller et al.
5,732,423 A 3/1998 Weismiller et al.
5,737,781 A 4/1998 Votel
5,745,937 A 5/1998 Weismiller et al.
5,790,997 A 8/1998 Ruehl
5,802,636 A 9/1998 Corbin et al.
5,802,640 A 9/1998 Ferrand et al.
5,806,111 A 9/1998 Heimbrock et al.
5,819,339 A 10/1998 Hodgetts
5,850,642 A 12/1998 Foster
5,890,238 A 4/1999 Votel
5,901,388 A * 5/1999 Cowan ..... 5/81.1 HS
5,937,456 A 8/1999 Norris
5,996,144 A 12/1999 Hodgetts
6,058,533 A 5/2000 Nelson
6,065,162 A 5/2000 Behr
6,108,837 A 8/2000 Knebel, III
6,128,796 A 10/2000 McCormick et al.
6,282,734 B1 * 9/2001 Holberg ..... 5/81.1 HS
6,289,533 B1 9/2001 Hodgetts
6,341,393 B1 1/2002 Votel
6,363,555 B1 4/2002 LaRose
6,378,148 B1 * 4/2002 Votel ..... 5/81.1 HS
D456,751 S 5/2002 Williams
6,393,636 B1 5/2002 Wheeler
6,484,332 B1 11/2002 Korver, II et al.
6,496,991 B1 12/2002 Votel
6,507,963 B1 1/2003 Hodgetts
6,526,606 B1 3/2003 Friedrich
6,539,569 B1 4/2003 O'Connell
6,560,793 B1 5/2003 Walker
6,591,435 B1 7/2003 Hodgetts
6,615,423 B1 * 9/2003 Sverdlik et al. ..... 5/81.1 C
6,629,323 B1 10/2003 Sverdlik et al.
6,662,388 B1 12/2003 Friel et al.
6,772,456 B1 * 8/2004 Votel ..... 5/81.1 R
2001/0044957 A1 11/2001 Hodgetts
2001/0047543 A1 12/2001 VanSteenburg et al.
2002/0029418 A1 3/2002 Votel
2002/0083521 A1 7/2002 Sverdlik
2002/0083522 A1 7/2002 Sverdlik
2002/0170110 A1 11/2002 Hodgetts
2003/0070226 A1 4/2003 Heimbrock
2003/0074732 A1 4/2003 Hanson et al.
2003/0100559 A1 5/2003 Sikorski et al.
2003/0100560 A1 5/2003 LaVoie et al.

FOREIGN PATENT DOCUMENTS

DE 1260692 2/1968
EP 0875228 4/1998
EP 1 155 673 A2 11/2001
FR 1487854 7/1967
FR 2624007 12/1987
FR 2687065 11/1992
GB 420697 12/1934
GB 1091031 11/1967
GB 1447163 8/1976
GB 2139487 11/1984
WO WO 86/00221 1/1986
WO WO 95/21600 8/1995
WO WO 97/09896 3/1997
WO WO 97/27770 8/1997
WO WO 98/44889 10/1998

* cited by examiner

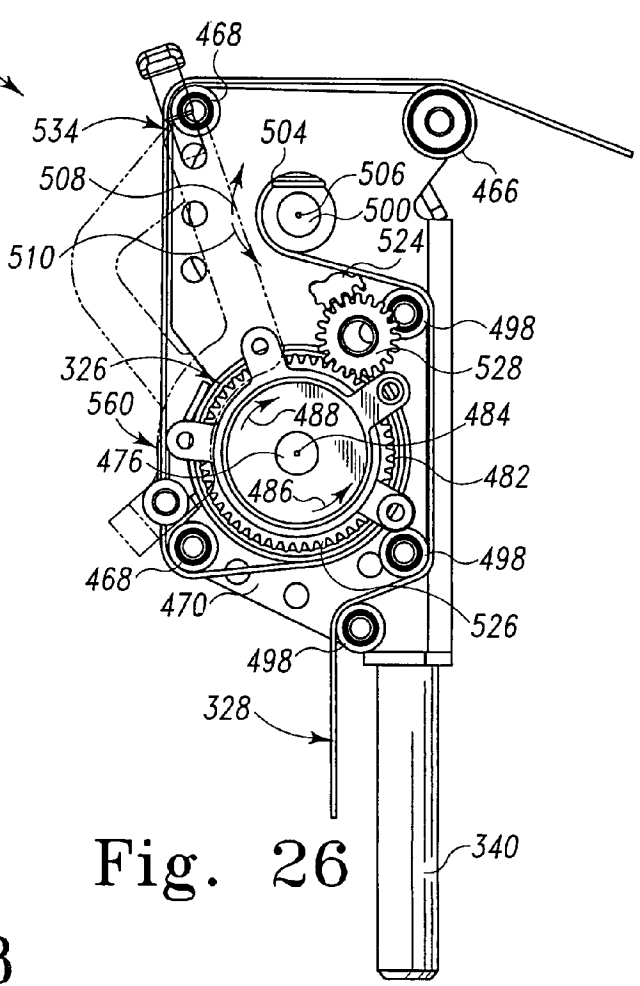
Fig. 26
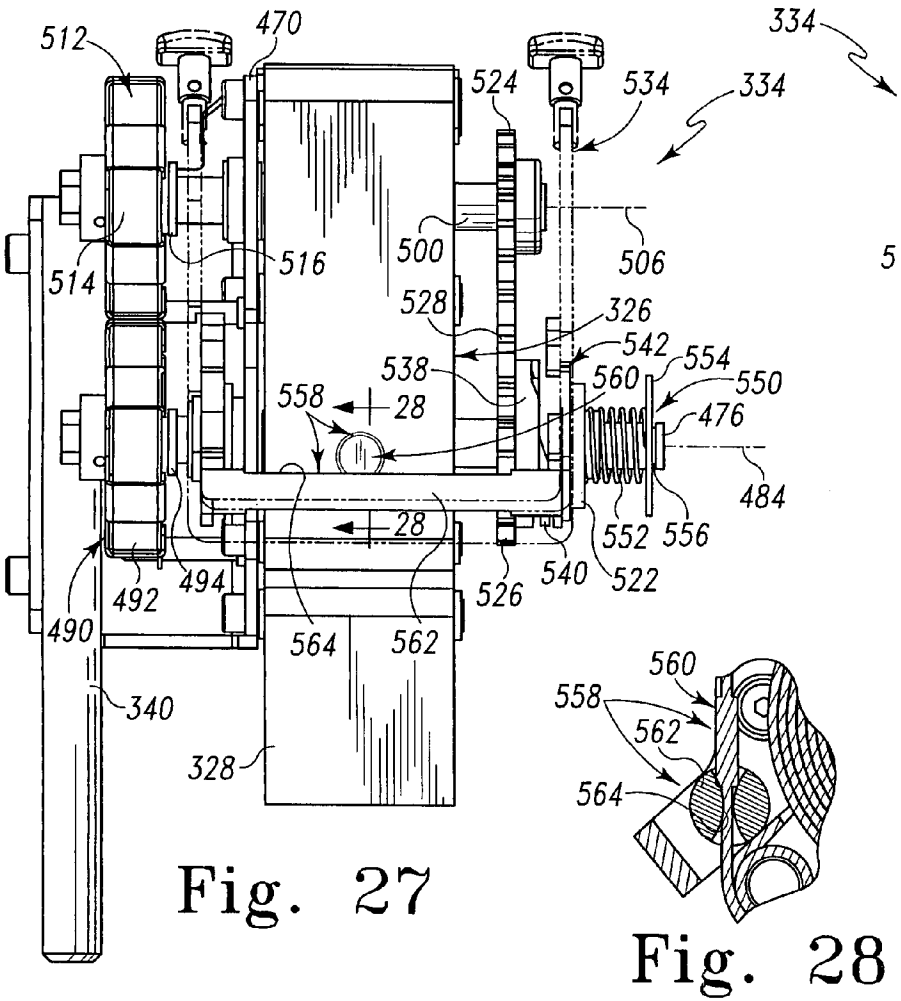
Fig. 27
Fig. 28

APPARATUS FOR PULLING PATIENT UP IN BED

This application is a Rule 371 application based upon PCT international patent application PCT/US03/18875 filed Jun. 13, 2003, which claims priority to U.S. Provisional Patent application Ser. No. 60/389,212 which was filed Jun. 17, 2002, and which is hereby incorporated herein by reference.

BACKGROUND OF THE INVENTION

The present invention relates to an apparatus for orienting a patient on a patient-support device, such as a hospital bed. More particularly, the present disclosure relates to an apparatus for pulling a patient toward a head end of a patient support device.

Some patient-support devices, such as hospital beds, stretchers, surgical tables, and the like, have mechanisms for articulating, raising, lowering, and/or tilting a patient-support portion of the device relative to a base of the device. When a head section of the patient-support portion of the device is raised to move the patient from a supine position to a sitting position, it is not uncommon for the patient to slide down the head section and move toward a foot end of the device. Thus, the patient may be shifted too far toward the foot end of the patient-support device when the head section is lowered back down to return the patient to the supine position. Some prior art devices, such as those shown in U.S. Pat. Nos. 5,608,929 and 5,280,657 and those shown in U.S. patent application Publications Nos. 2002/0083521 A1 and 2002/083522 A1, include mechanisms for pulling a patient toward the head end of a hospital bed.

SUMMARY OF THE INVENTION

An apparatus for positioning a patient on a patient-support device is provided, the apparatus comprising one or more of the following features or combinations thereof. A sheet gripper may comprise a bar that wraps up in the sheet and one or more hooks that engage the bar and the sheet wrapped around the bar. The bar may be coupled to the housing of the sheet gripper by a first tether. A second tether may extend between the housing and a base portion of the patient-support device. The second tether may be wound upon a winder when a patient-support portion of the patient-support device is lowered toward the base portion. The sheet gripper may comprise a lock that prevents the second tether from unwinding from the winder when the patient-support portion is raised relative to the base portion. The second tether pulls the sheet gripper and the sheet toward a head end of the patient-support device when the patient-support portion is raised relative to the base portion. The lock may be releasable so that the second tether unwinds from the winder when the patient-support portion is raised relative to the base portion.

A tether control unit may be used to control relative motion between a first tether coupled to the sheet gripper and the tether control unit and a second tether coupled to the tether control unit and the base portion. In a tether coupling mode of operation, the tether control unit may be used to wind up the first tether to pull the sheet gripper and, thus, a sheet gripped by the sheet gripper and a patient on the sheet toward the tether control unit in response to unwinding of the second tether due to raising of the patient-support portion. In a tether decoupling mode of operation, the tether control unit may be used to decouple relative motion between the first and second tethers so as not to move the patient on the patient-support portion when the patient-support portion is lowered.

The sheet gripper may comprise a roller about which the sheet may be wrapped and a ratchet assembly configured to have an engaged state for the sheet gripper to grip the sheet and a disengaged state for the sheet gripper to release the sheet. In the engaged state, the illustrative ratchet assembly permits rotation of the roller in a sheet-wrapping direction and blocks rotation of the roller in a sheet-unwrapping direction. In the disengaged state, the ratchet assembly may permit rotation of the roller in both the sheet-wrapping and sheet-unwrapping directions to facilitate unwrapping of the sheet from the roller. The sheet gripper may comprise a manual release to move the ratchet assembly from its engaged state to its disengaged state.

The tether control unit may comprise a first winder for winding up the first tether and a second winder for winding up the second tether. In an engaged state, a clutch may couple the first and second winders together so that the first winder winds up the first tether in response to unwinding of the second tether by the second winder upon raising the patient-support portion. In a disengaged state, the clutch may decouple the first and second winders from one another so that the first winder does not wind or unwind the first tether when the second winder winds up the second tether upon lowering of the patient-support portion.

An actuator may be used to move the clutch between its engaged and disengaged states. The actuator may be activated manually or may be activated automatically by a tether winding limiter. The tether winding limiter may be used to move the clutch from its engaged state to its disengaged state to limit the extent to which the first winder can wind up the first tether.

Additional features will become apparent to those skilled in the art upon consideration of the following detailed description of illustrative embodiments exemplifying the best mode of carrying out the various inventions disclosed herein as presently perceived.

BRIEF DESCRIPTION OF THE DRAWINGS

The detailed description particularly refers to the accompanying figures in which:

FIG. 7 is a side elevation of the bed in the supine orientation showing the patient in a desired therapeutic orientation corresponding with his feet being spaced from a foot end of the bed by a distance A;

FIG. 8 is a side elevation of the bed now moved to the reclined orientation showing the patient moved from the desired therapeutic orientation, toward the foot end of the bed, with his feet being spaced from the foot end of the bed now by a distance B, shorter than A;

FIG. 9 is a side elevation of the bed moved again to the supine orientation, showing the patient's feet spaced from the foot end of the bed by a distance B;

FIG. 10 is a side elevation of the bed moved again to the reclined orientation, showing the patient moved still farther from the desired therapeutic orientation, with his feet overhanging the foot end of the bed by a distance C;

FIG. 11 is a side elevation of the bed in the lowered position and supine orientation showing the patient in the desired therapeutic orientation corresponding with his feet being spaced from the foot end of the bed by the distance B;

FIG. 12 is a side elevation of the bed now moved to the raised position, showing the patient positioning apparatus pulling the sheet and the patient to the desired therapeutic orientation with his feet spaced from the foot end by the distance A;

FIG. 13 is a side elevation of the bed returned to the lowered position, showing the patient in the desired therapeutic orientation, with his feet spaced from the foot end by the distance A;

FIG. 26 is a side elevation view, with portions broken away, showing the tether control unit in its tether decoupling mode;

FIG. 27 is a front elevation view, with portions broken away, showing the tether control unit in its tether decoupling mode; and FIG. 28 is a sectional view taken along lines 28—28 of FIG. 27.

DETAILED DESCRIPTION OF THE DRAWINGS

Figure 1:
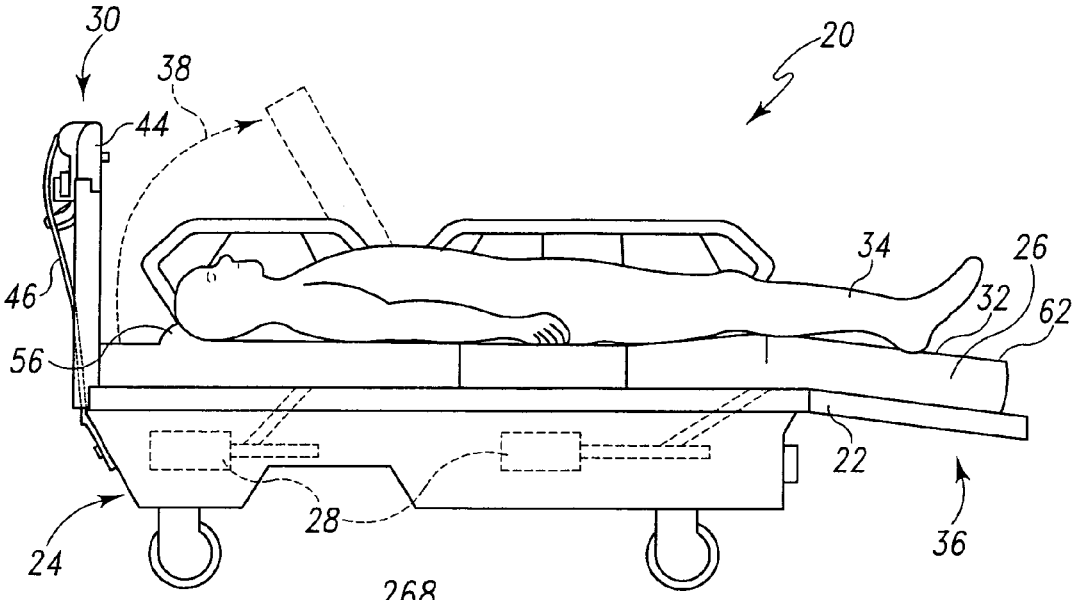
FIG. 1 is a side elevational view of a hospital bed and a patient positioning apparatus for coupling to a sheet to move a patient to a desired therapeutic orientation, the apparatus shown mounted in a stored position on a headboard of the bed, and the bed shown in a supine or flat orientation (in solid) and a reclined orientation (in phantom)
Figure 7:
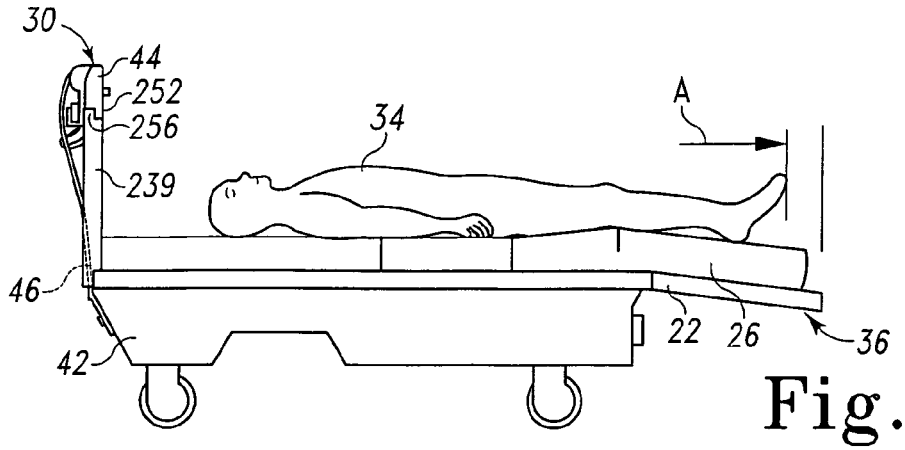
FIGS. 7–10 show a sequence in which the patient positioning apparatus is in the stored position and the bed is moved between the supine or flat orientation and the reclined orientation.
Figure 8:
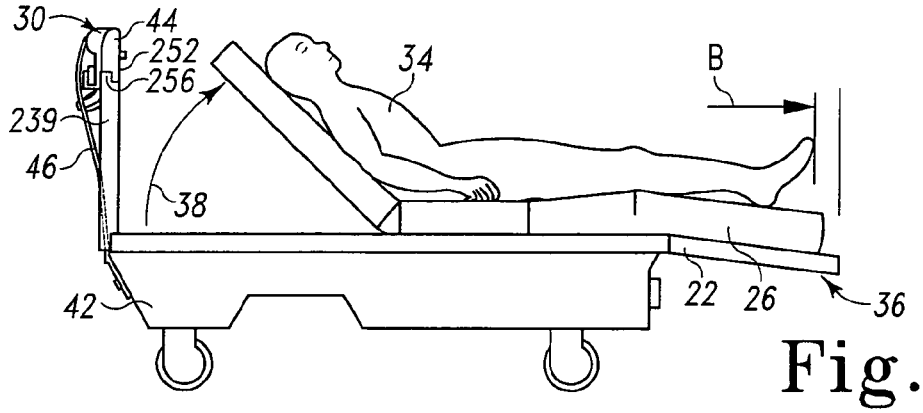
Figure 9:
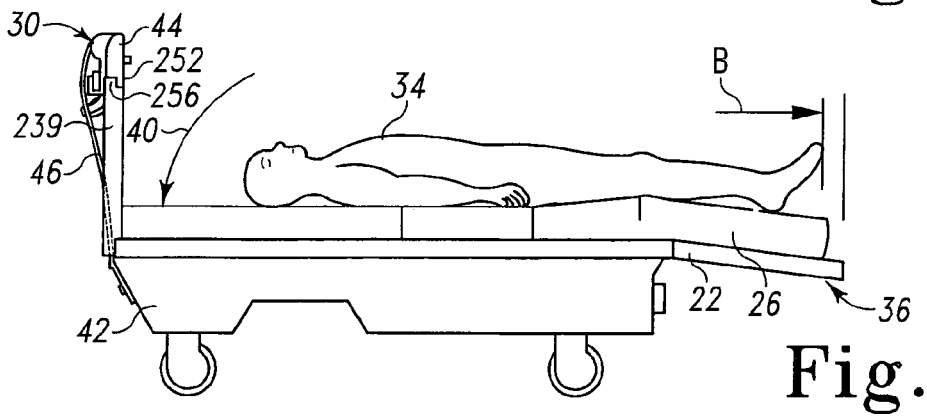
Figure 10:
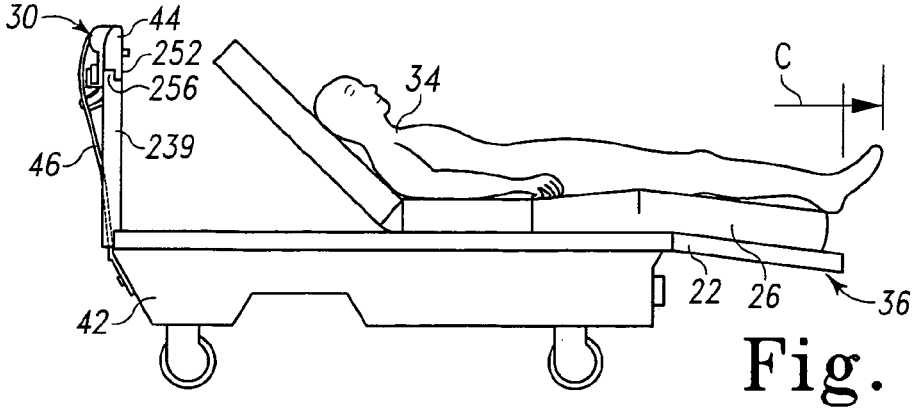

A hospital bed 20 includes a patient support deck 22 coupled to a base portion or lower frame portion 24 for supporting support deck 22 above the floor as shown in FIG. 1. Bed 20 includes a mattress 26 supported by patient support deck 22. Mattress 26 and deck 22 provide a patient-support portion of bed 20. Bed 20 includes a drive mechanism 28 to adjust regions of bed 20 to move mattress 26 among multiple positions. Such positions include a generally supine or flat position, such as shown in FIGS. 7 and 9, a reclined position, such as shown in FIGS. 8 and 10, a raised position as shown in FIG. 12, and a lowered position shown in FIG. 11. One example of such a drive mechanism is disclosed in U.S. Pat. No. 5,715,548, the disclosure of which is hereby expressly incorporated by reference.

Figure 3:
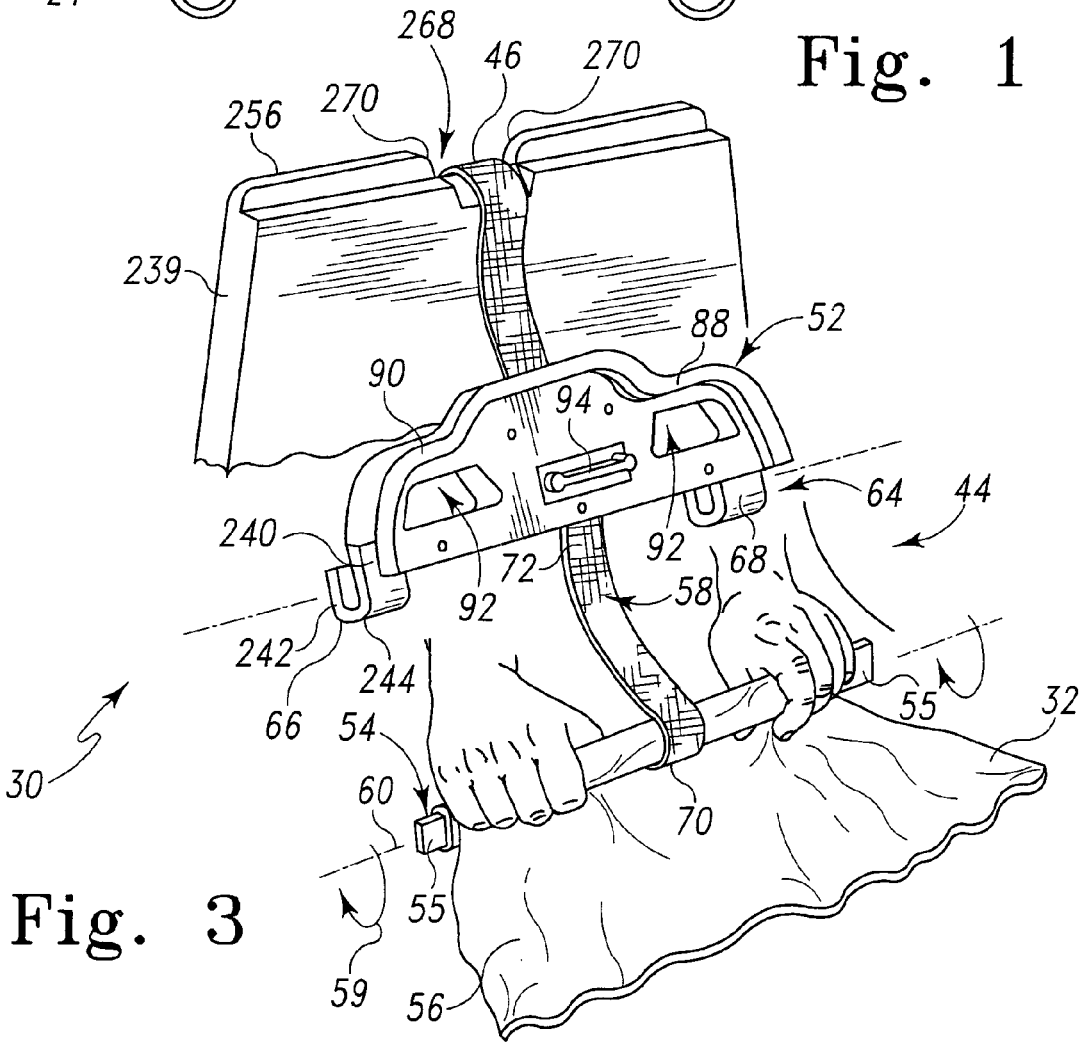
FIG. 3 is a perspective view of the sheet coupler showing a caregiver rolling up a head end of the sheet in the sheet connection bar and the main assembly positioned to couple to the sheet connection bar.
Figure 13:
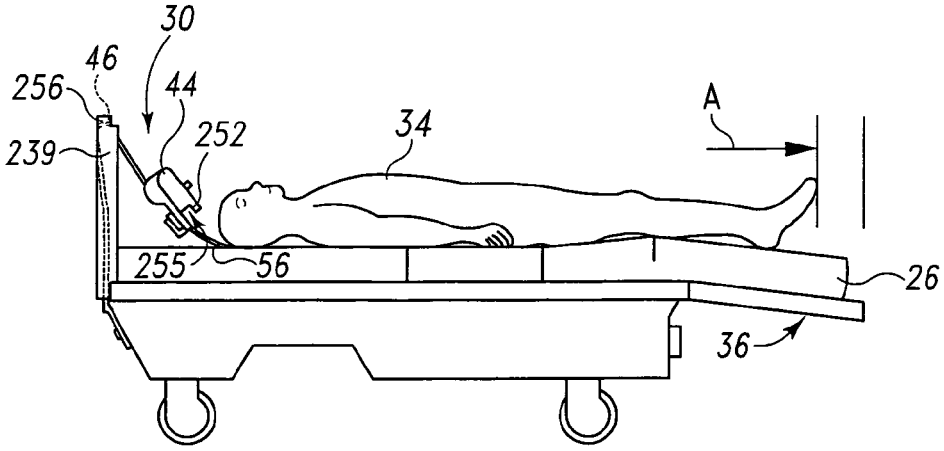

As illustrated in FIG. 3, an illustrative patient positioning apparatus 30 is coupled to bed 20 and to a sheet 32 to grip and pull sheet 32 toward a head end 56 of bed 20 as bed 20 is moved to the raised position. To move a patient 34 back to the desired therapeutic position, a caregiver couples apparatus 30 to sheet 32, actuates apparatus 30 to prevent lengthening of the apparatus, and moves bed 20 toward a raised position. Because apparatus 30 is secured to a portion of bed 20 that does not move with mattress 26, apparatus 30 pulls sheet 32 relative to mattress 26 as bed 20 is raised. This returns patient 34 to the desired therapeutic position, as shown in FIG. 13.

When apparatus 30 is in its stored orientation, as illustrated in FIGS. 1 and 7–10, and bed 20 is moved from a supine position (FIG. 7) to a reclined position (FIG. 8), patient 34 on sheet 32 is moved or scooted toward foot end 36 of bed 20. In FIG. 7, patient 34 is shown in a desired therapeutic position, corresponding with the patient's feet being a distance A from foot end 36 of bed 20. As shown in FIG. 8, bed 20 has been moved from the position of FIG. 7 in direction 38 to the reclined position, forcing patient 34 toward foot end 36 of bed 20 so that the patient's feet are a distance B from foot end 36. Thus, patient 34 has been moved a distance equal to the difference between distances A and B. As bed 20 is returned to the supine position and moved again to the reclined position, as shown in FIGS. 9 and 10 respectively, patient 34 is moved farther toward foot end 36 of bed 20 so that the patient's feet are a distance C from foot end 36. Thus, patient 34 has been moved an overall distance equal to the difference between distances A and C.

To correct the position of patient 34, apparatus 30 is coupled to sheet 32 and is actuated (as explained more fully below), and bed 20 is moved from the lowered position shown in FIG. 11 to the raised position shown in FIG. 12. As bed 20 is moved in direction 39 to the raised position, apparatus 30 grips sheet 32 and, since it is secured to the bed frame, pulls sheet 32 toward the head end 56 of mattress 26. Thus, as bed 20 is moved in direction 39 to the raised position, patient 34 is pulled along with sheet 32 to the desired therapeutic position shown in FIGS. 1 and 13, w ith his feet again at a distance A from foot end 36.

Figure 2:
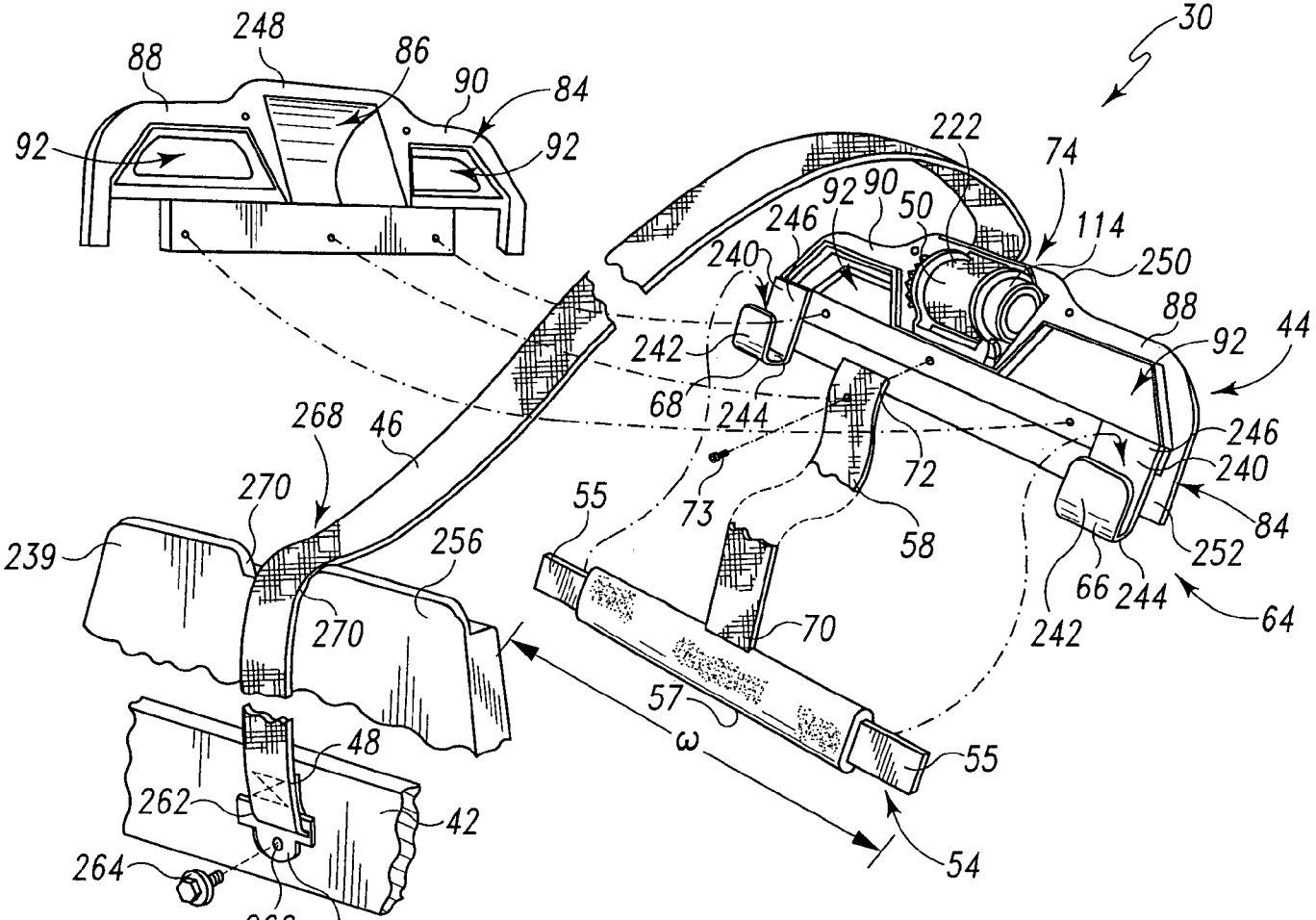
FIG. 2 is a fragmentary exploded perspective view of the apparatus of FIG. 1, showing a main assembly coupled to the bed by a first belt, a portion of its housing removed to expose a tensioning mechanism, and a sheet coupler with a connection bar coupled thereto by a second belt.

Patient positioning apparatus 30 is coupled to bed 20, illustratively to a frame member 42 of bed 20. Apparatus 30 includes a sheet gripper or sheet coupler 44 to selectively couple apparatus 30 to sheet 32. Apparatus 30 includes a first tether or belt 46 to secure the sheet coupler 44 to bed 20. Sheet coupler 44 is coupled to or grips sheet 32. As shown in FIG. 2, first belt 46 is coupled at a first belt end 48 to bed frame member 42 and at a second belt end 50 to sheet coupler 44. First belt 46 is under tension from sheet coupler 44 to remove unnecessary slack from first belt 46 by winding belt 46 as described more fully below.

Figure 5:
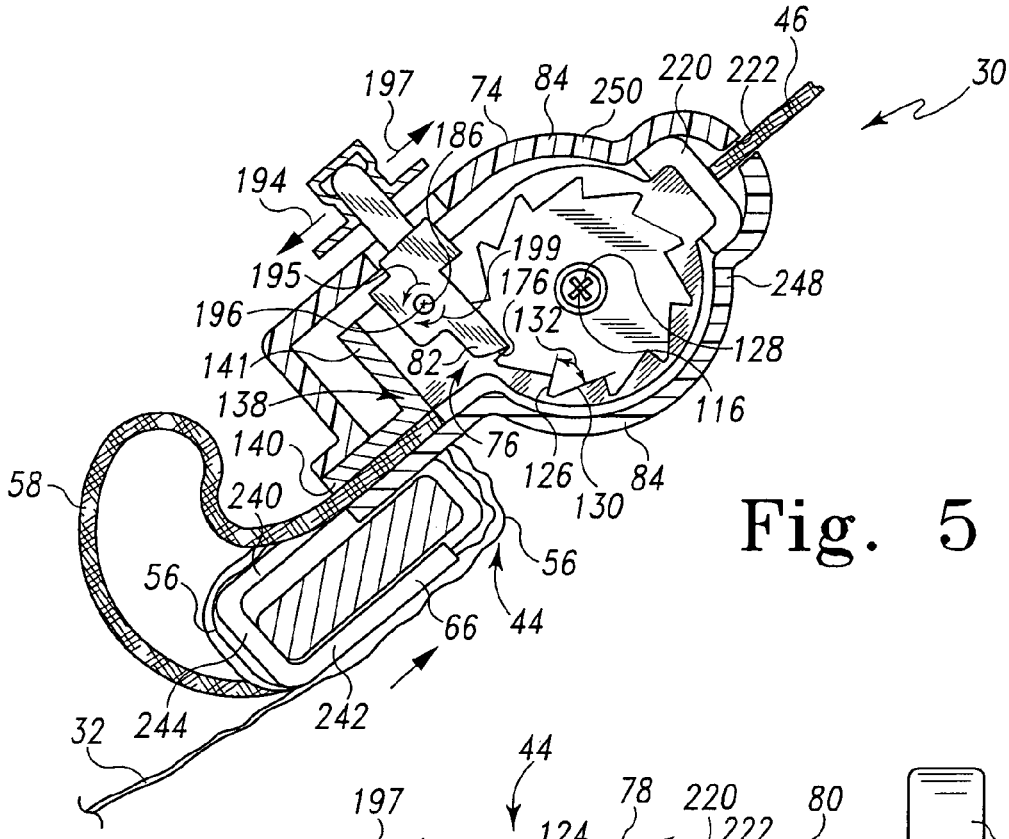
FIG. 5 is a sectional side view of the sheet coupler taken generally along section line 5—5 of FIG. 2 showing a pawl moved to an actuated position engaging a toothed wheel in a locked orientation to inhibit lengthening of the first belt, and the connection bar coupled to a retainer on the main assembly.
Figure 6:
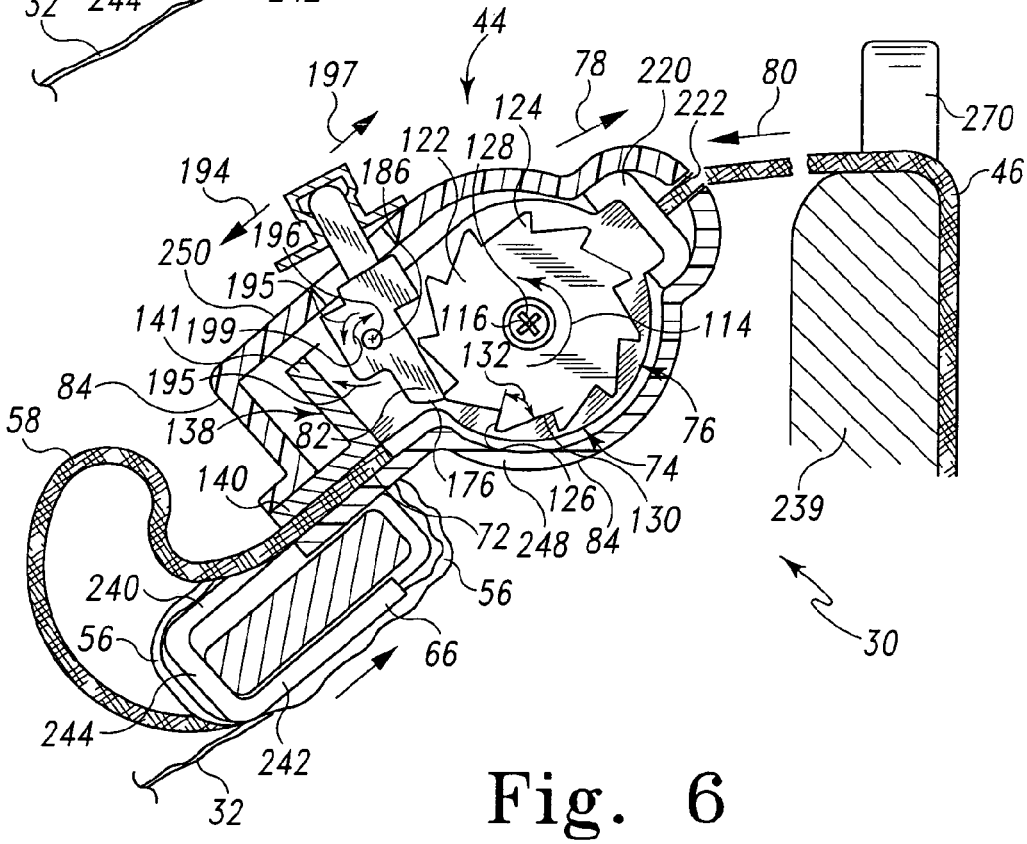
FIG. 6 is a sectional side view similar to FIG. 5, showing a handle moved to a position releasing the pawl from the locked orientation of FIG. 5 to a released position disengaged from the toothed wheel, and the tensioning mechanism rotating to remove slack in the first belt, moving the main assembly toward a head board of the bed.

Sheet coupler 44 includes a main assembly 52 and a sheet connection bar 54 around which a caregiver wraps part of a head end 56 of sheet 32. Sheet connection bar 54 is coupled to the main assembly 52 with a tether or second belt 58. As shown in FIG. 3, to connect sheet 32 with sheet coupler 44, sheet connection bar 54 is placed adjacent head end 56 of sheet 32. Bar 54 is rotated in direction 59 about a longitudinal axis 60 through bar 54, rolling bar 54 toward a foot end 62 of sheet 32 so that a portion of head end 56 of sheet 32 is wrapped around bar 54. With this portion of sheet 32 wrapped as such, bar 54 is coupled to retainer 64, as shown in FIGS. 5 and 6, which inhibits movement of bar 54 and thus sheet 32.

A first end 70 of second belt 58 is secured to sheet connection bar 54, and a second end 72 of belt 58 is secured to main assembly 52, illustratively with a screw 73. Second belt 58 has a length that enables a caregiver to maneuver bar 54, illustratively to permit several turns of bar 54 about axis 60, to wrap sheet 32 thereabout.

As shown in FIGS. 2, 3, 5 and 6, retainer 64 is, illustratively, a pair of spaced apart hooks 66, 68 in which bar 54 is inserted to retain sheet 32. Sheet 32 is retained by pinching the head end 56 of sheet 32 between the hooks 66, 68 and outer regions 55 of bar 54, inhibiting sheet 32 from unwinding from bar 54. Illustratively, a central portion 57 of bar 54 has a surface that is relatively abrasive so that it grips sheet 32 to inhibit removal of sheet 32. Central portion 55 may have applied thereon a foam, a grit, a tackifier, or other material or combination of materials to increase the friction between central portion 55 and sheet 32. As shown in FIG. 2, sheet connection bar 54 has a width W—illustratively between about 6 and 18 inches (about 15.2 cm and 45.7 cm). However, sheet connection bar 54 can have a wide variety of widths to permit a sufficient region of sheet 32 to be wrapped in bar 54 to couple sheet 32 to sheet coupler 44.

As shown in FIGS. 2, 4–6, main assembly 52 includes a winder or tensioning mechanism 74 to take up slack in first belt 46. Tensioning mechanism maintains the tension on belt 46 by winding up the excess length of belt 46 between bed 20 and main assembly 52. Tensioning mechanism 74 includes a ratchet 76 to selectively permit movement of sheet coupler 44 relative to first belt 46 in a belt shortening direction 78 and a belt-lengthening direction 80. Illustratively, a caregiver actuates a pawl 82 to move the ratchet to a latched or actuated position so that sheet coupler 44 is inhibited from moving relative to first belt 46 in a belt-lengthening direction 80, but uncoiling of first belt 46 in belt-lengthening direction 80 is permitted. Together, the ratchet 76 and pawl 82 provide a ratchet assembly.

Main assembly 52 includes a housing 84 having a recess 86 to house the tensioning mechanism 74 and the portion of first belt 46 that is coiled up by tensioning mechanism 74. Main assembly 52 includes retainer 64, illustratively spaced apart hooks 66, 68 coupled to sides of housing 84. As shown in FIGS. 5 and 6, hooks receive sheet connection bar 54, holding a portion of sheet 32 between hooks 66, 68 and bar 54. Housing 84 includes a pair of handles 88, 90 illustratively bordering an opening 92 through housing 84 on each side of recess 86. To manually move sheet 32, without using drive mechanism 28, when sheet coupler 44 is coupled to sheet 32 one or more caregivers inserts a hand into an opening 92 and pulls on one of handles 88, 90 of main assembly 52, and moves the patient to a desired position.

Tensioning mechanism 74 maintains tension on first belt 46 by automatically winding or coiling belt 46, removing slack in the portion of belt 46 between sheet coupler 44 and bed 20. First belt 46 is uncoiled by pulling sheet coupler 44 toward foot end 36. The tensioning action of tensioning mechanism 74 can be suspended by actuating a handle 94 to inhibit winding of belt 46 to permit a caregiver to have enough slack in first belt 46 to couple sheet coupler 44 to sheet 32.

Tensioning mechanism 74 includes a bracket 110 coupled to housing 84. Bracket 110 supports a spool 112 about which first belt 46 is coiled or wound. A biasing member 114, illustratively a torsion or rotary spring, is coupled to spool 112 and housing 84 to bias spool 112 in direction 114 about an axis 116 extending longitudinally through spool 112, as shown in FIGS. 5 and 6. Thus, first belt 46 is biased in belt-shortening direction 78.

Figure 4:
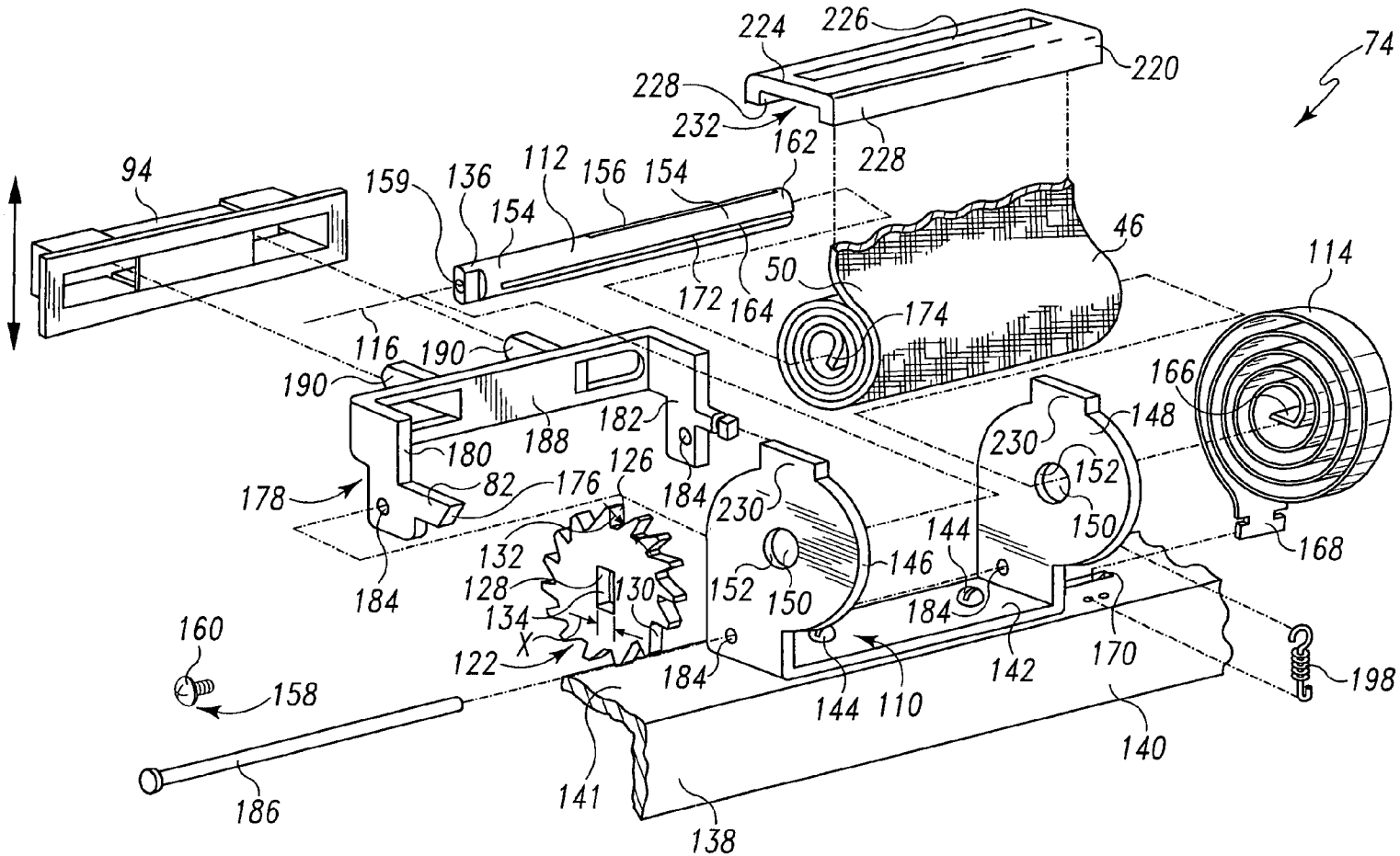
FIG. 4 is an exploded perspective view of the tensioning mechanism.

As shown in FIGS. 4–6, tensioning mechanism 74 further includes ratchet 76 to selectively restrict movement of spool 112. Ratchet 76 includes a wheel 122 having teeth 124 projecting radially outwardly around the circumference of wheel 122. Each of teeth 124 includes a straight surface 126 that lies generally in a plane extending radially from center 128 of wheel 122. Each of teeth 124 includes a sloped surface 130 forming an acute angle 132 with straight surface 126. Wheel 122 includes an opening 134 at its center 128 to receive a first end 136 of spool 112 therein. Opening 134 is complementary in shape to first end 136, illustratively rectangular when viewed along axis 116. When handle 94 is moved to the latched or actuated position shown in FIG. 5, ratchet 76 illustratively permits rotation of spool 112 in direction 114 but inhibits movement in the opposite direction.

As illustrated in FIG. 4, spool 112 is rotatably supported by bracket 110. Bracket 110 is coupled to a support mount 138 that has an L-shape when viewed in cross section, as illustrated in FIGS. 5 and 6. Support mount 138 has a first region 140 to which retainer 64 and second belt 58 are coupled. Support mount 138 also has a second region 141 to which bracket 110 is coupled, as shown in FIG. 4.

As shown in FIG. 4, bracket 110 includes a base 142, illustratively a substantially flat plate, formed to include holes (not shown) therein to receive retainers 144 therethrough to couple bracket 110 to mount 138. A pair of spaced flanges 146, 148 extends from base 142, each flange 146, 148 formed to include a spool aperture 150 therein. Spool aperture 150 is defined by a bearing surface 152 sized and shaped complementarily to the journals 154 on spool 112. Spool 112 is inserted into spool aperture 150 so that journals 154 are aligned with bearing surfaces 152.

A central portion 156 of spool 112 is situated between flanges 146, 148, and first end 136 projects outside one of flanges 146, 148, positioned to be received in opening 134 of wheel 122. Wheel 122 is thus mounted on end 136 of spool 112, and secured thereto by retainer 158, illustratively a screw received in a screw aperture 159 formed in first end 136 of spool 112. Retainer 158 has a head 160 larger than a width X of opening 134 to sandwich wheel 122 between one of flanges 146, 148 and retainer head 160. Thus, wheel 122 is coupled to spool 112 and configured to move therewith.

A second end 162 of spool 112 extends beyond the other of flanges 146, 148. A spring-receiving slot 164 is formed in second end 162 and receives a first portion 166 of biasing member 114. A second portion 168 of biasing member 114 is coupled to mount 138, illustratively inserted in a notch 170 formed in second region 141 of support mount 138. A belt-receiving slot 172 is formed in central portion 156 of spool 112 to receive distal end 174 of first belt 46.

As shown in FIG. 5, to limit unwinding of first belt 46, an engagement surface 176 of pawl 82 engages straight surface 126 of one of teeth 124. Pawl 82 is coupled to a main body 178 including spaced apart walls 180, 182 that lie adjacent portions of flanges 146, 148. Holes 184 through each wall 180, 182 and flanges 146, 148 are aligned and receive a pin 186 therethrough to pivotally mount main body 178 to bracket 110. A central bar 188 extends between and couples to each of walls 180, 182 of main body 178. As shown in FIGS. 5 and 6, a projection 190 extends from central bar 188, through an opening 192 formed in housing 84. Actuator or handle 94 is coupled to projection 190 to permit a caregiver to actuate ratchet 76 and move pawl 82.

As shown in FIG. 6, when a caregiver actuates ratchet 76 by moving handle 94 in direction 194, pawl 82 moves in direction 195 about an axis 196 through pin 186 to the position illustrated in FIG. 5, so that engagement surface 176 engages straight surface 126. In this orientation, movement of sheet coupler 44 relative to first belt 46 is inhibited in belt-lengthening direction 78 so that the caregiver can move bed 20 to the raised position shown in FIG. 12. Ratchet 76 and pawl 82 provide means for preventing belt 46 from unwinding when bed 20 is raised.

Handle 94 is biased by pawl biasing member 198, illustratively a coil spring, to a position so that pawl 82 disengages wheel 122 and engagement surface 176 normally disengages straight surface 126. It is within the scope of this disclosure, however, for handle 94 and pawl 82 to be biased so pawl 82 normally engages wheel 122. It is also within the scope of this disclosure to eliminate pawl biasing member 198 so that handle 94 and pawl 82 are not biased in either direction. It is also within the scope of this disclosure for teeth 124 to be shaped and pawl 82 to be shaped and/or positioned relative to teeth 124 so that first belt 46 is not automatically wound about spool 112, but pawl 82 must first be disengaged to wind belt 46 about spool 112.

As shown in FIG. 6, a caregiver releases or moves handle 94 so that pawl 82 is in the released position shown in FIG. 6 when first belt 46 needs to be lengthened, such as when the caregiver is disconnecting sheet coupler 44 from sheet 32 or when the caregiver removes main assembly 52 from the stowed position to couple sheet coupler 44 to sheet 32. When handle 94 is moved in direction 197 to the actuated or latched position shown in FIG. 5, pawl 82 moves in direction 199 about axis 196, and pawl 82 engages teeth 124 to inhibit rotation of spool 112.

Illustratively, tensioning mechanism 74 automatically removes slack from first belt 46 when first belt 46 is not taut. Pawl 82 moves to permit spool 112 to rotate in belt-shortening direction 78. As wheel 122 rotates about axis 116 in response to the bias of biasing member 114, sloped surface 130 cams against a cam surface 178 of pawl 82, moving pawl 82 against the bias of pawl biasing member 198 to disengage engagement surface 176 from straight surface 126. Thus, slack is automatically removed from first belt 46. It is within the scope of this disclosure to eliminate the automatic tensioning of ratchet 76, for example, by eliminating the sloped surface 130 so that pawl 82 engages one or more of teeth 124 to inhibit motion of spool 112 in both directions about axis 116.

Main assembly 52 includes a belt guide 220 to guide first belt 46 from opening 222 in housing through which belt 46 moves at it is wound and unwound from spool 112. Belt guide 220 is illustratively a plate having a substantially flat central portion 224 including a slot 226 formed therein. Slot 226 has a width slightly larger than the width of first belt 46. A wall 228 extends from each edge of central portion 224 generally parallel to the length of slot 226. An ear 230 extends upwardly from each flange 146, 148 and fits in recess 232 formed by the junction of walls 228 and central portion 224. When housing 84 is assembled, belt guide 220 is held in place between housing 84 and ears 230. First belt 46, residing in slot 226, also inhibits movement of belt guide 220.

In the stored position of apparatus 30, sheet coupler 44 is coupled to a headboard 239 of bed 20. Hooks 66, 68 are illustratively J-shaped, having a relatively longer leg 240, a relatively shorter leg 242, and a lower section or bight 244 joining the two legs. Ends 246 of longer legs 240 are coupled to main assembly 52, illustratively to support mount 138. Ends 246 are situated between a first part 248 of housing 84 and support mount 138. Illustratively, housing 84 includes a second part 250 that couples to first part 248 to house some of the components described above.

Housing 84 assists in retention of apparatus 30 in the stored position. Second part 250 of housing 84 includes a lip 252 extending downwardly from an interior surface 254 of housing 84. Lip 252 extends generally parallel to longer leg 240 of each hook 66, 68, forming a space 255 between lip 252 and retainer 64. To store apparatus 30, lip 252 and retainer 64 are placed over an upper edge 256 of headboard 239. Upper edge 256 is thus situated in the space 255 between hooks 66, 68 and lip 252 so that sheet coupler 44 is releasably stored on headboard 239. It is within the scope of this disclosure for lip 252 to extend the length from a location adjacent one hook 66, 68 to a location adjacent the other hook, for lip 252 to be one or more smaller portions that cooperate with one or both of hooks 66, 68 to form a space between which upper edge 256 is situated when sheet coupler 44 is stored.

As shown in FIG. 2, first belt 46 is secured to bed 20 by coupling a first belt end 48 of first belt 46 to bed frame member 42. Bed frame member 42 is illustrated in FIGS. 1 and 7–13 as part of the support structure of bed 20, however it is within the scope of this disclosure for frame member 42 to be the headboard 239, some other portion of bed 20, or another object that does not move with mattress 26 as bed 20 is moved among the raised, lowered, supine, and reclined positions. First belt 46 can be coupled to bed 20 in a variety of ways. As illustrated in FIG. 2, belt 46 is coupled to a bracket 260—first end 48 of belt 46 is fed through a slot 262 formed in bracket 260 and coupled to itself. A fastener 264, illustratively a screw, couples bracket 260 to frame member 42, illustratively extending through a hole 266 formed in bracket 260.

Figure 11:
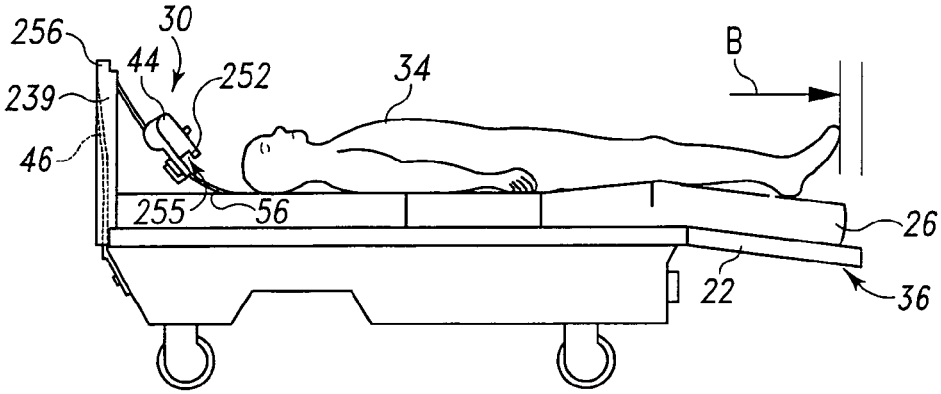
FIGS. 11–13 show a sequence in which the patient positioning apparatus is coupled to a bed sheet, and the bed is moved between the lowered position and the raised position.
Figure 12:
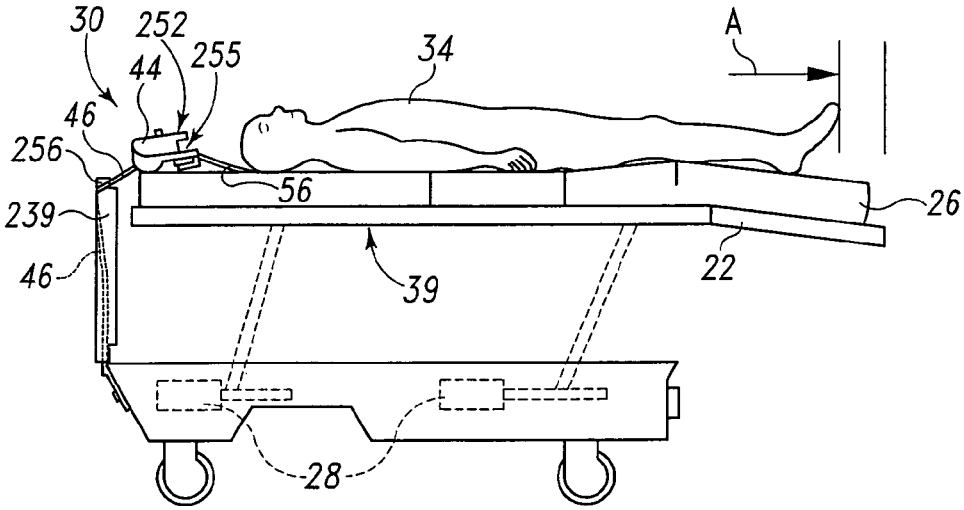

When sheet coupler 44 is coupled to sheet 32, as illustrated in FIGS. 11–13, first belt 46 stretches from tensioning mechanism 74, over the upper edge 256 of headboard 239, to its point of coupling with bed 20. First belt is situated in a retention groove or notch 268 formed in upper edge 256. Walls 270 of notch 268 limit lateral movement of belt 46 as sheet coupler 44 is moved.

Although first and second belts 46, 58 are illustratively webs, it is within the scope of this disclosure that, where first and/or second belts 46, 58 are provided, a variety of flexible connecting members, such as one or more of cords, lines, cables, chains, ties, straps, bands, or the like, may be used. Additionally, alternative arrangements of bed 20 are within the scope of this disclosure.

Figure 14:
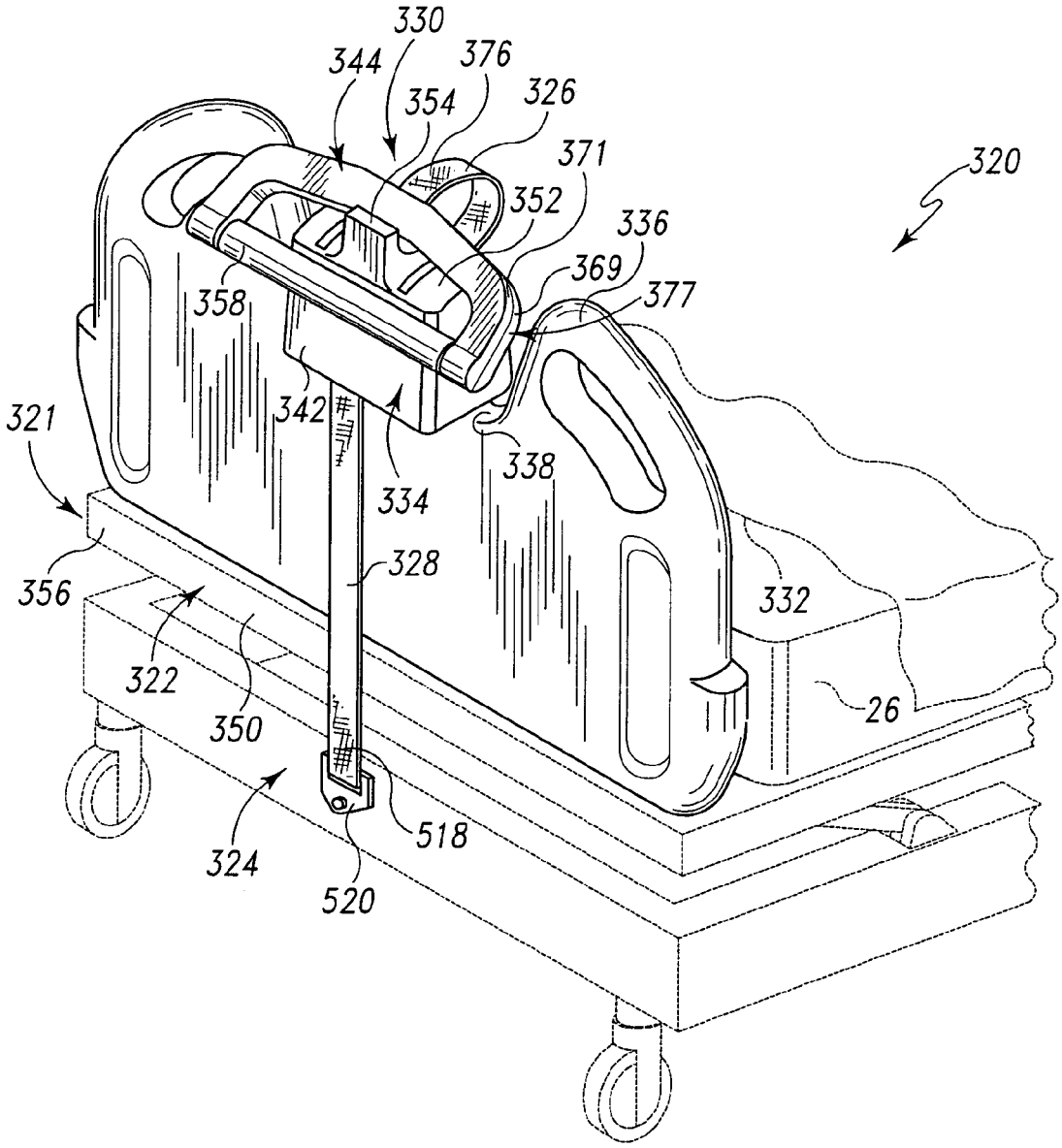
FIG. 14 is a perspective view showing a patient positioning apparatus mounted to a headboard of a patient-support device.
Figure 15:
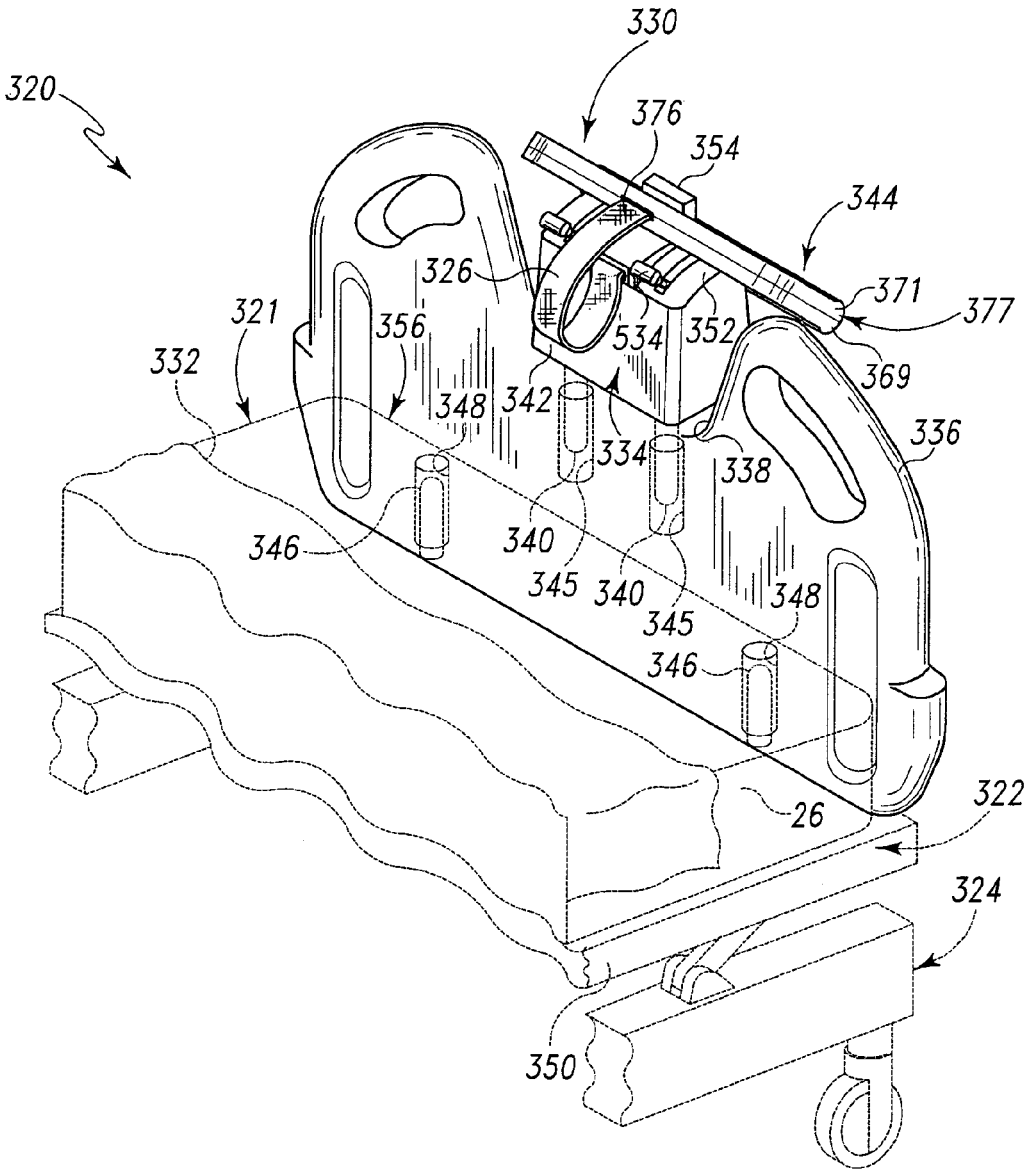
FIG. 15 is another perspective view of the patient positioning apparatus of FIG. 14 showing mounting of the apparatus to the headboard and mounting of the headboard to a frame of the patient-support portion.

A patient positioning apparatus 330 for use with a patient-support device 320 is illustrated in FIGS. 14 and 15. Apparatus 330 is used to pull a patient (not shown) up on the patient-support device 320 by pulling a sheet 332 underlying the patient toward a head end 356 of a periphery 321 of the device 320 in response to raising of a patient-support portion 322 of the device 320.

Patent positioning apparatus 330 comprises a sheet gripper 344, first and second tethers 326, 328, and a tether control unit 334, as illustrated in FIGS. 14 and 15. The sheet gripper 344 is coupleable to the sheet 332 to grip the sheet 332. The first tether 326 extends between the sheet gripper 344 and the tether control unit 334 and the second tether 328 extends between the tether control unit 334 and a base portion 324 of the patient-support device 320. The tether control unit 334 is used to control winding and unwinding of the tethers 326, 328 to pull the sheet gripper 344 and, thus, the sheet 332 and the patient thereon toward the head end 356 when the patient-support portion 322 is raised.

Patient positioning apparatus 330 is configured to be mounted to a headboard 336 of the patient-support portion 322 for movement therewith, as illustrated in FIGS. 14 and 15. The headboard 336 is formed to include a recess 338 that receives the patient positioning apparatus 330. Control unit mounting posts 340 extend into control unit mounting post sockets 345 formed in the headboard 336 to mount the apparatus 330 thereto. Headboard mounting posts 346 extend into headboard mounting post sockets 348 formed in the headboard 336 to mount the headboard 336 to a patient-support portion fame 350 of the patient-support portion 322.

The control unit housing 342 comprises an upper panel 352 and a sheet gripper retainer 354 extending upwardly therefrom. The sheet gripper 344 is configured to be mounted on the upper panel 352 to be retained by the retainer 354 for storage of the sheet gripper 344 during periods of non-use of the patient positioning apparatus 330, as shown in FIGS. 14 and 15.

Figure 16:
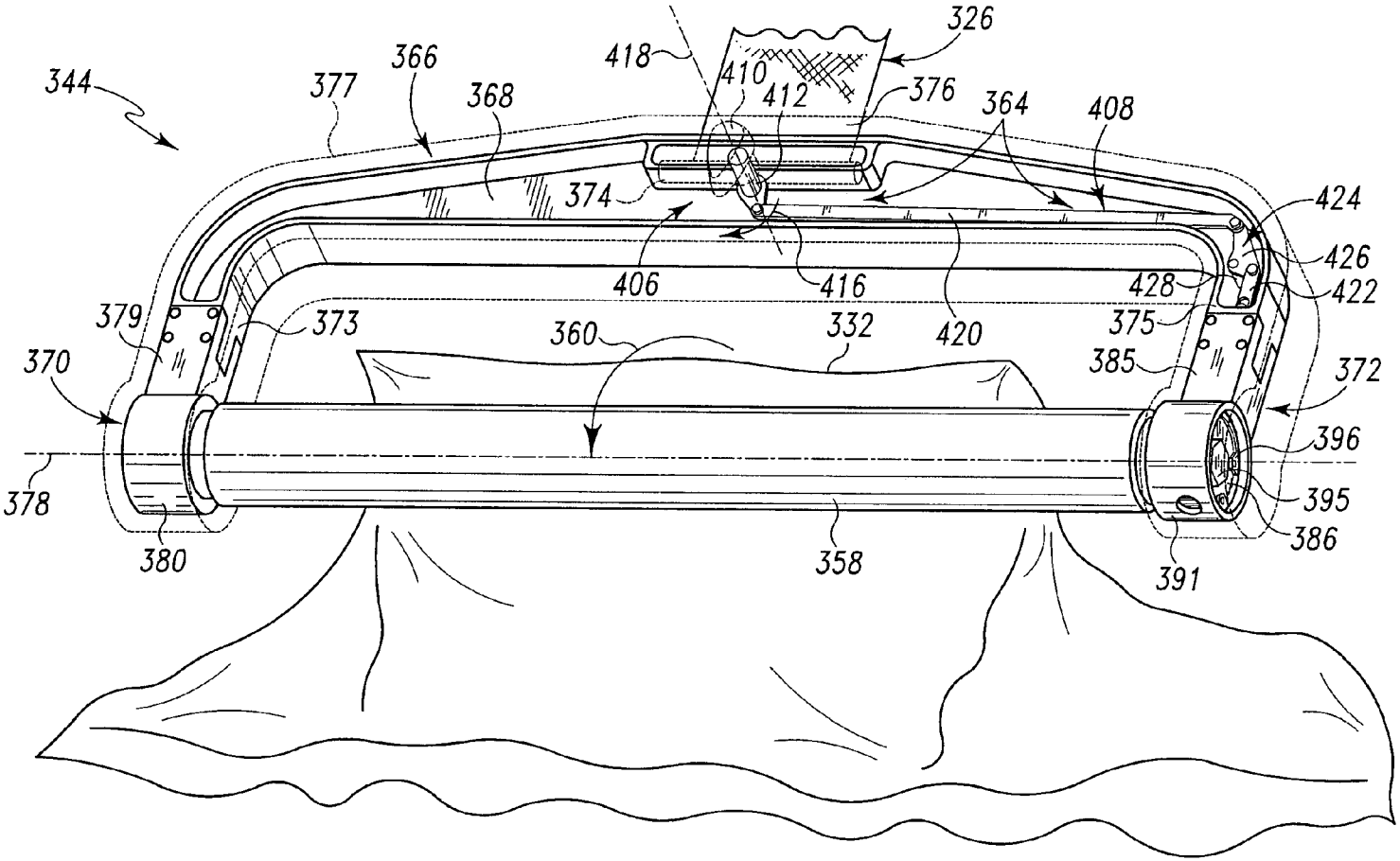
FIG. 16 is a perspective view of a sheet gripper of the apparatus of FIGS. 15 and 16 showing wrapping of a sheet around a roller of the sheet gripper.

The sheet 332 is to be wrapped around a roller 358 of the sheet gripper 344 for the sheet gripper 344 to grip the sheet 332, as suggested in FIG. 16. The sheet gripper 344 comprises a unidirectional rotation blocker illustratively in the form of a ratchet assembly 359 that has an engaged state and a disengaged state. In the engaged state, the ratchet assembly 359 is configured to permit the roller 358 to spin about a rotation axis 378 in a sheet-wrapping, first direction 360 and to prevent the roller 358 from spinning about the axis 378 in a sheet-unwrapping, second direction 362 to facilitate wrapping of the sheet 332 around the roller 358 and gripping of the sheet 332 by the sheet gripper 344. In the disengaged state, the ratchet assembly 359 is configured to permit the roller 358 to spin about the axis 378 in both directions 360, 362 to facilitate unwrapping of the sheet 332 from the sheet gripper 344. A manual release 364 is used to move the ratchet assembly 359 between its engaged and disengaged states.

Figure 17:
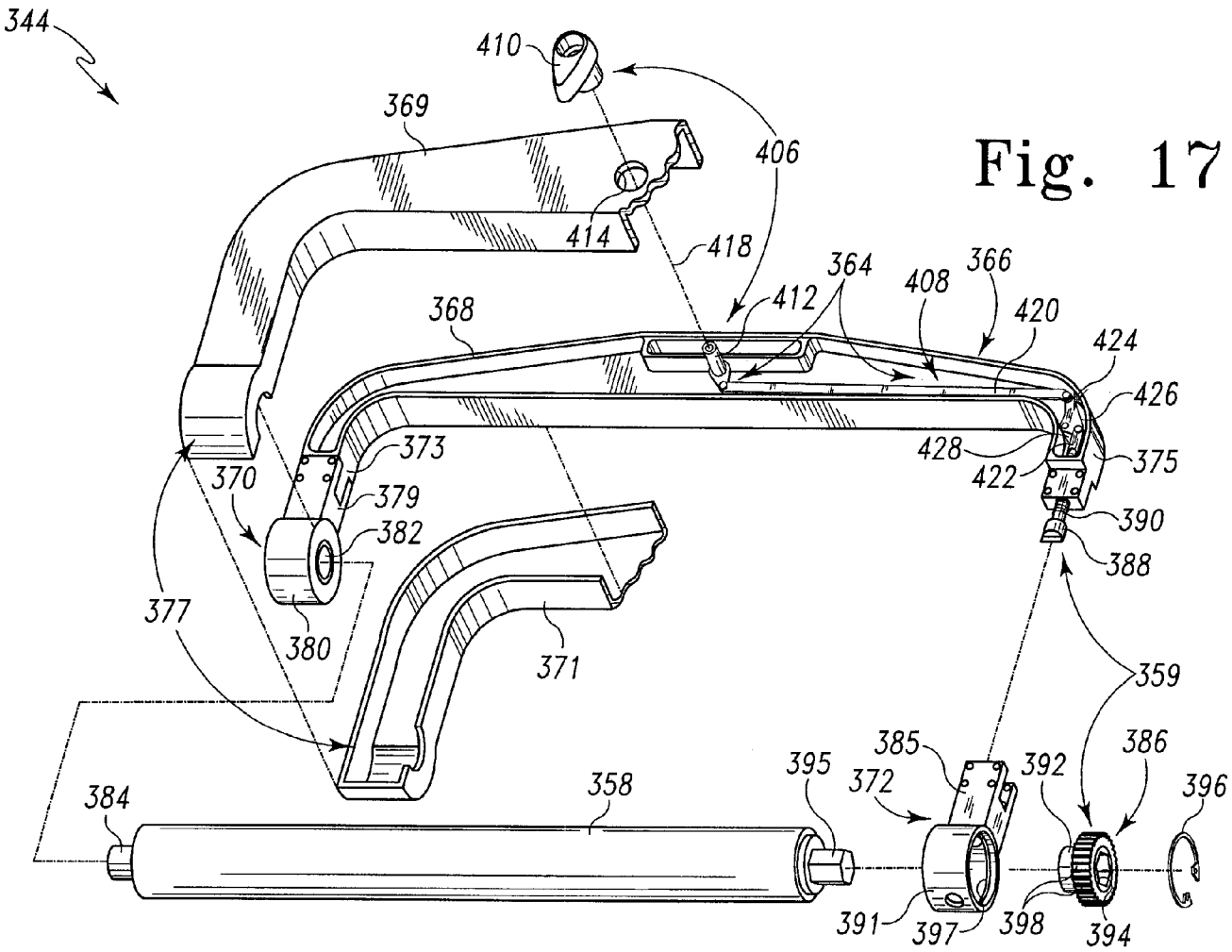
FIG. 17 is an exploded perspective view showing components of the sheet gripper of FIG. 16.

The sheet gripper 344 comprises an arm 366 to which the roller 358, the ratchet assembly 359, the manual release 364, and the first tether 326 are mounted, as shown in FIGS. 16 and 17. The arm 366 comprises an arm base portion 368 and first and second roller supports 370, 372. The base portion 368 comprises a centrally-located tether coupler 374 to which a sheet gripper end 376 of the first tether 326 is coupled. The first and second roller supports 370, 372 are fixed to opposite ends 373, 375 of the arm base portion 368 and support the roller 358 for rotation about the rotation axis 378. First and second cover members 369, 371 of an arm cover 377 cooperate to house the components of the arm 366.

The first roller support 370 comprises a collar mount 379, a collar 380, and an axle bearing 382, as shown in FIGS. 16 and 17. The collar mount 379 is fixed to the base portion end 373. The collar 380 is mounted to the collar mount 379. The axle bearing 382 is positioned inside the collar 380. A first axle 384 of the roller 358 has a circular cross-section and extends into the axle bearing 382 for rotation relative thereto about the axis 378.

Figure 18:
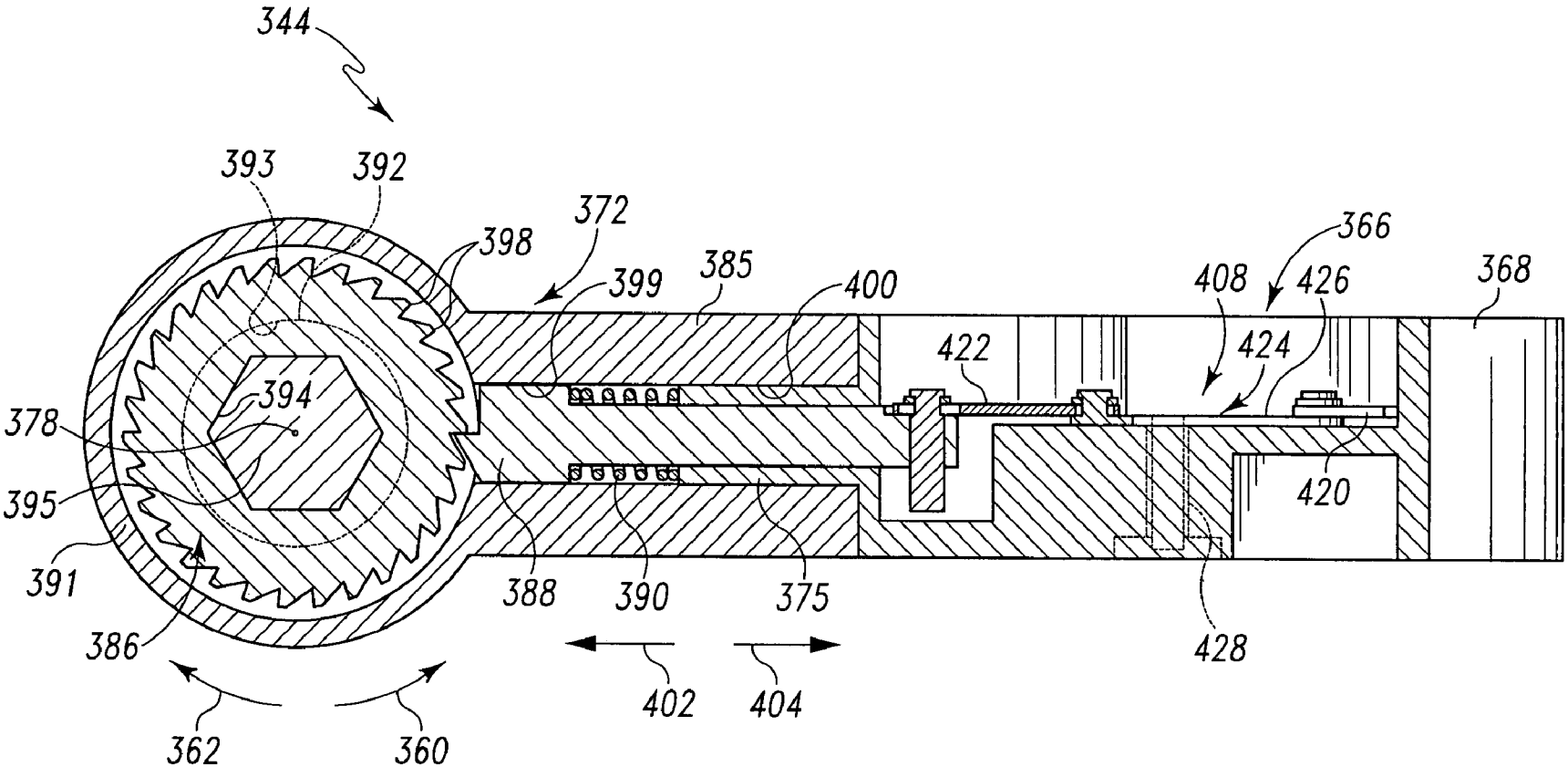
FIG. 18 is a sectional view taken along lines 18—18 of FIG. 16.

The second roller support 372 comprises a collar mount 385 and a collar 391, as shown in FIGS. 16–18. The collar mount 385 is fixed to the base portion end 375. The collar 391 is mounted to the collar mount 385.

The ratchet assembly 359 comprises a ratchet wheel 386, a pawl 388, and a pawl biaser 390, as shown in FIGS. 17 and 18. The wheel 386 is positioned inside the collar 391. The wheel 386 comprises a hub 392 journaled in a hub bearing 393 of the collar 391 shown in FIG. 18 for rotation of the wheel 386 about the axis 378. The hub 392 comprises an axle-receiving channel 394 that is configured to mate with a second axle 395 of the roller 358 extending into the channel 394 so that the wheel 386 and the roller 358 are rotatable together about the axis 378. Illustratively, each of an inner contour of the channel 392 and an outer contour of the second axle 394 is hexagon-shaped. A C-shaped retainer ring 396 is positioned within a groove 397 formed in the collar 391 to retain the wheel 386 inside the collar 391.

In the engaged state of the ratchet assembly, the pawl 388 is positioned to engage canted teeth 398 formed in the wheel 386 to permit rotation of the wheel 386 and roller 358 in the sheet-wrapping direction 360 and to block rotation of the wheel 386 and roller 358 in the sheet-unwrapping direction 362 in the engaged state of the ratchet assembly 359, as shown in FIG. 18. In the disengaged state of the ratchet assembly, the pawl 388 disengages the teeth 398 to permit rotation of the wheel 386 and roller 358 in both directions 360, 362.

The pawl 388 is positioned for linear movement in a pawl-receiving channel 399 formed in the collar mount 385 and a pawl-receiving channel 400 formed in the base portion end 375. The pawl 388 is movable linearly in teeth-engagement direction 402 to engage teeth 398 and in teeth-disengagement direction 404 to disengage teeth 398, as shown in FIG. 18.

The pawl biaser 390 biases the pawl 388 yieldably toward the wheel 386 in the teeth-engagement direction 402. Illustratively, the pawl biaser 388 is a coil spring that engages the pawl 388 and the base portion end 375, as shown in FIG. 18.

The manual release 364 is coupled to the pawl 388 to move the pawl 388 in the teeth-disengagement direction 404. The manual release 364 comprises a rotatable actuator 406 shown in FIGS. 16 and 17 and a motion converter 408 shown in FIGS. 16–18 and configured to convert rotation of the actuator 406 into linear movement of the pawl 388 in teeth-disengagement direction 404.

The actuator 406 comprises a user engagement knob 410, a pin 412, and a crank arm 413, as shown in FIGS. 16 and 17. The knob 410 and the crank arm 413 are mounted to the pin 412 which is rotatably coupled to the arm 366 to facilitate rotation of the knob 410, pin 412, and crank arm 413 together about a rotation axis 418 as discussed in more detail below. The knob 410 extends through a knob-receiving aperture 414 formed in the first cover member 369 for mounting to the pin 412.

Illustratively, the motion converter 408 is a linkage comprising first and second links 420, 422 and a pivot 424 interconnecting the first and second links 420, 422, as shown in FIGS. 16–18. The first link 420 is coupled to the crank arm 413 and a pivot plate 426 of the pivot 424. The second link 422 is coupled to the plate 426 and a pin 428 interconnecting the second link 422 and the pawl 390. The plate 426 is mounted on a pivot post 430 that is pivotably coupled to the base portion 368 for pivotable movement of the plate 426 to transmit motion between the links 420, 422.

A user activates the manual release 364 to permit unwrapping of the sheet 332 from the roller 358. A user activates the manual release 364 by engaging the knob 410 and rotating it in a release direction 416 about the rotation axis 418, thereby causing rotation of the knob mount 412 and the crank arm 413 with the knob 410. The motion converter 408 converts such rotation of the components of the actuator 406 into linear movement of the pawl 388 away from the wheel 386 in teeth-disengagement direction 404. Rotation of the crank arm 413 moves the first link 420 so as to pivot the pivot 424. Pivoting the pivot 424 moves the second link 422 so as to withdraw the pawl 390 away from the teeth 398 of the wheel 386 in disengagement direction 404. Disengagement between the pawl 390 and the wheel 386 allows the roller 358 to rotate in sheet-unwrapping direction 362 to facilitate unwrapping of the sheet 332 from the roller 358 and, thus, release of the sheet 332 from sheet gripper 344. When the user lets go of the knob 410, the pawl biaser 390 moves the pawl 388 in engagement direction 402 back into engagement with wheel 386.

Figure 19:
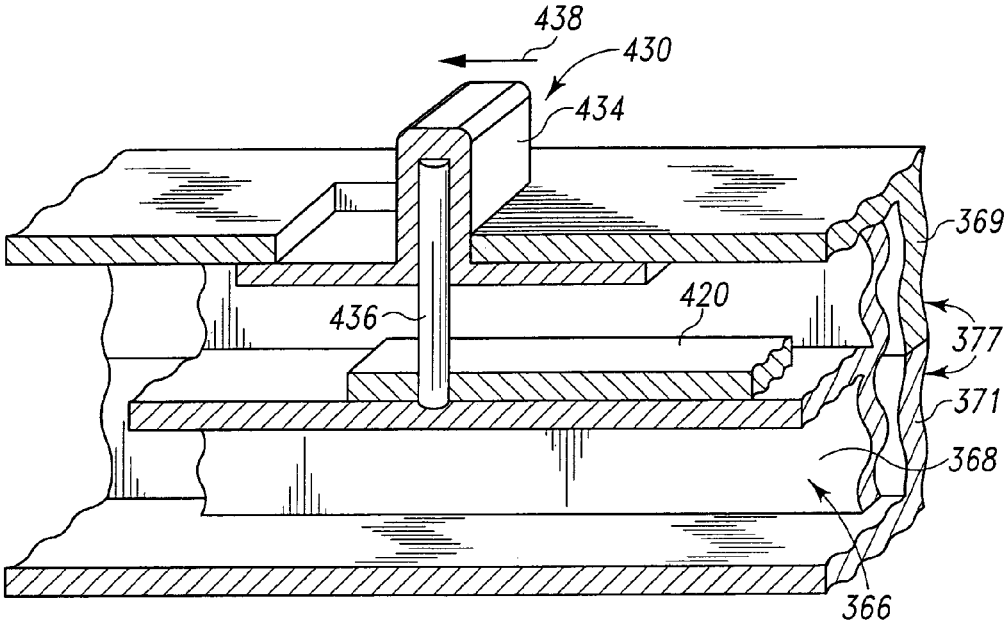
FIG. 19 is shows an optional detail, with portions broken away, for use with the sheet gripper of FIGS. 16–18.
Figure 20:
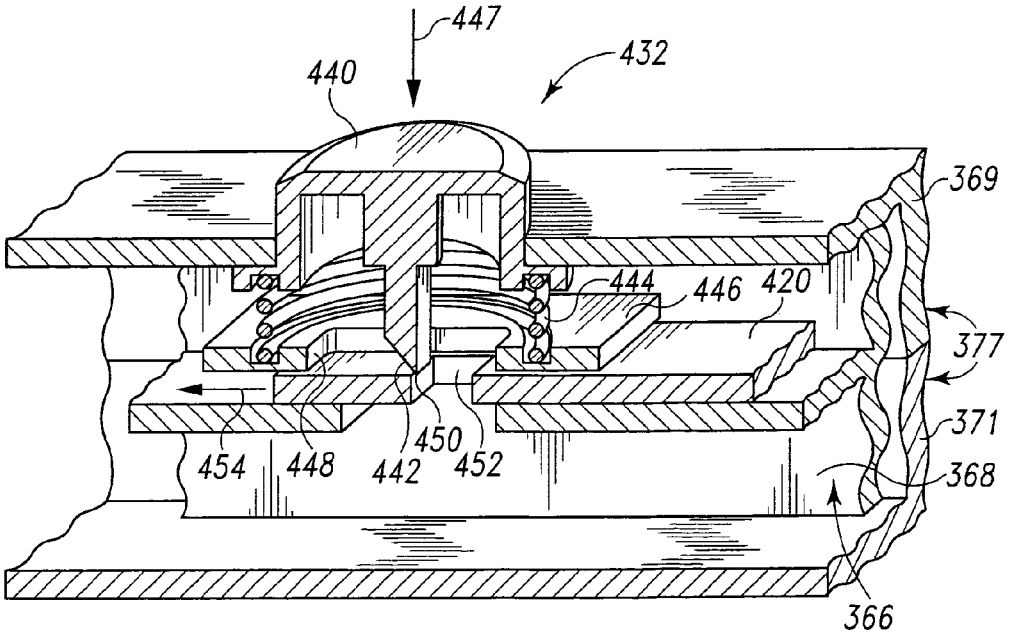
FIG. 20 shows another optional detail, with portions broken away, for use with the sheet gripper of FIGS. 16–18.

Other actuators may be used in place of the rotatable actuator 406. Two such optional actuators are shown in FIGS. 19 and 20. In particular, a slide actuator 430 is shown in FIG. 19 and a button actuator 432 is shown in FIG. 20.

The slide actuator 430 comprises a slider 434 and a connecting pin 436 interconnecting the slide 434 and the first link 420. To move the ratchet assembly 359 from its engaged state to its disengaged state, a user moves the slider 434 linearly in a release direction 438. Such linear movement of the slider 434 is transmitted to the first link 420 by the connecting pin 436.

The button actuator 432 comprises a button 440 and a cam 442 depending therefrom. A button biaser 444 positioned on a ledge 446 fixed to the arm base portion 368 normally biases the button 440 for extension of button 440 out of the first cover member 369 for access to a user. Illustratively, the button biaser 444 is a coil spring. Depression of the button 440 in direction 447 causes the cam 442 to move therewith through a first cam-receiving opening 448 formed in the ledge 446 and against an edge 450 defining a second cam-receiving opening 452 formed in the first link 420. Such movement of the cam 442 against the edge 450 causes the first link 420 to move in a second direction 454 at right angles to the first direction 447, thereby pulling the pawl 388 away from the wheel 386.

Optionally, the manual release 364 may be replaced by a Bowden wire connected to the pawl 388 and a Bowden wire actuator configured to move the Bowden wire to release the pawl 388 from the wheel 386.

Figure 23:
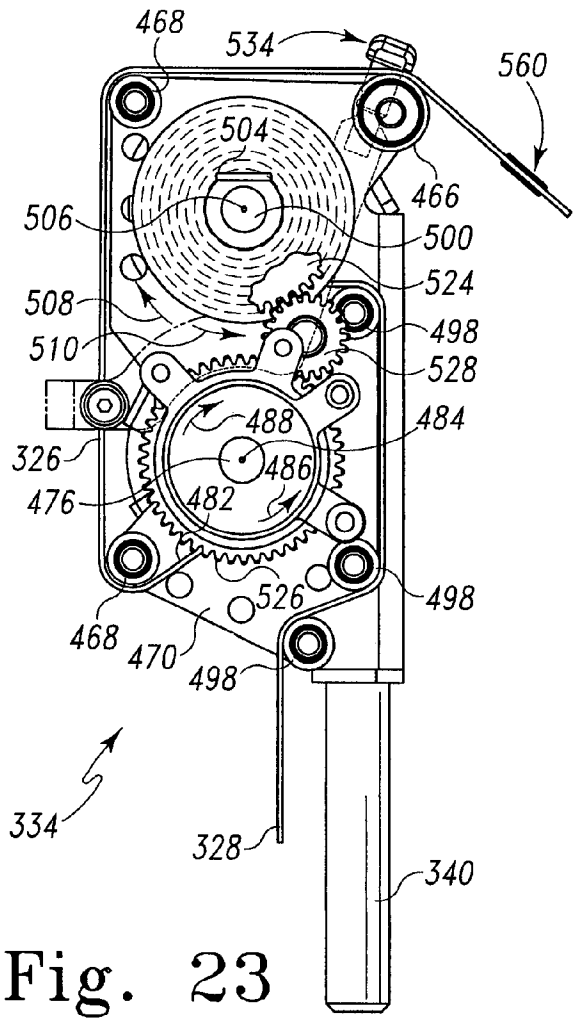
FIG. 23 is a side elevation view, with portions broken away, showing the tether control unit in its tether coupling mode.
Figure 24:
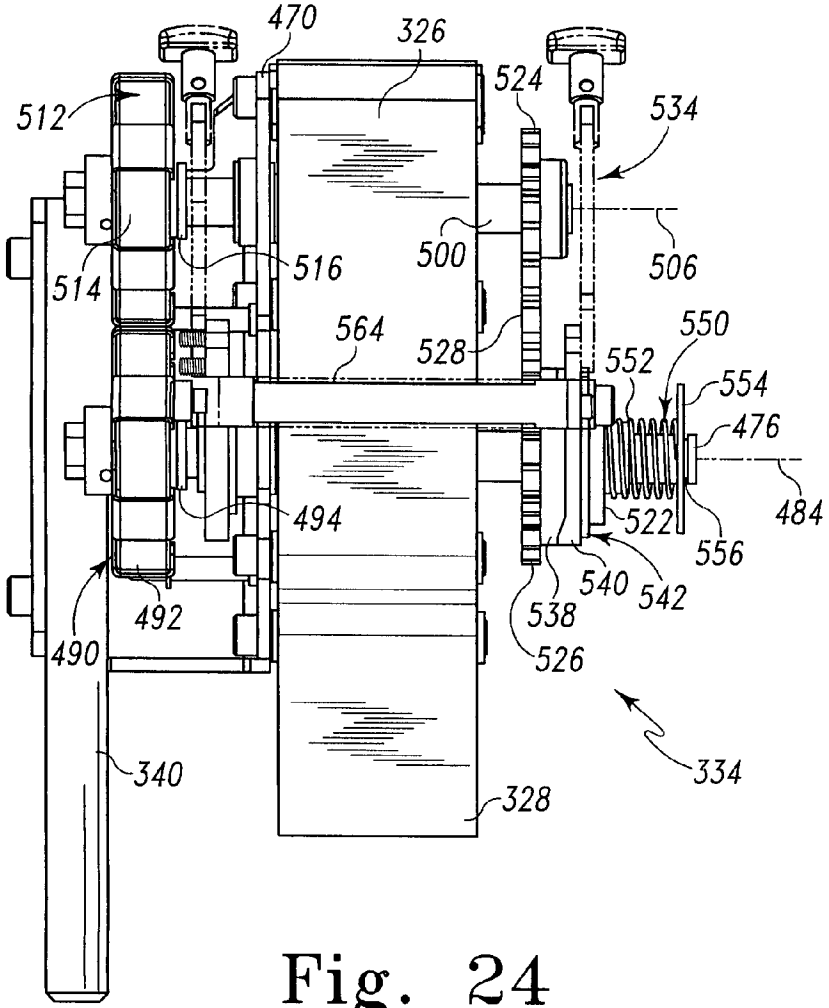
FIG. 24 is a front elevation view, with portions broken away, showing the tether control unit in its tether coupling mode.

The tether control unit 334 is configured to control winding and unwinding of the first and second tethers 326, 328 as the patient-support portion 322 is raised and lowered relative to the base portion 324 of the patient-support device 320. The tether control unit 334 is selectively operable in a tether coupling mode of operation shown in FIGS. 22–24 and a tether decoupling mode of operation shown in FIGS. 25–28. In the tether coupling mode of operation, the tether control unit 334 winds up the first tether 326 in response to unwinding of the second tether 328 due to raising of the patient-support portion 322. As the first tether 326 winds up, it pulls the sheet gripper 344, the sheet 332 gripped by the sheet gripper 344, and a patient positioned on the sheet 332 toward the head end 356 of the patient-support device 320 to facilitate sitting the patient up on the patient-support portion 322 upon articulation thereof to a sitting position. In the tether decoupling of operation, the tether control unit 334 permits the second tether 328 to wind up without winding or unwinding of the first tether 326 as the patient-support portion 322 is lowered.

To move a patient toward the head end 356, the tether control unit 334 is configured in its tether coupling of operation and the patient-support portion 322 is raised. If the patient needs to be moved some more toward the head end 356, the tether control unit 334 is configured in its tether decoupling of operation and the patient-support portion 322 is lowered. The tether control unit 334 is then reconfigured in its tether coupling of operation and the patient-support portion 322 is raised again thereby causing the patient to move closer to the head end 356. This process can be repeated as necessary until the patient is positioned on the patient-support portion 322 as desired.

Figure 21:
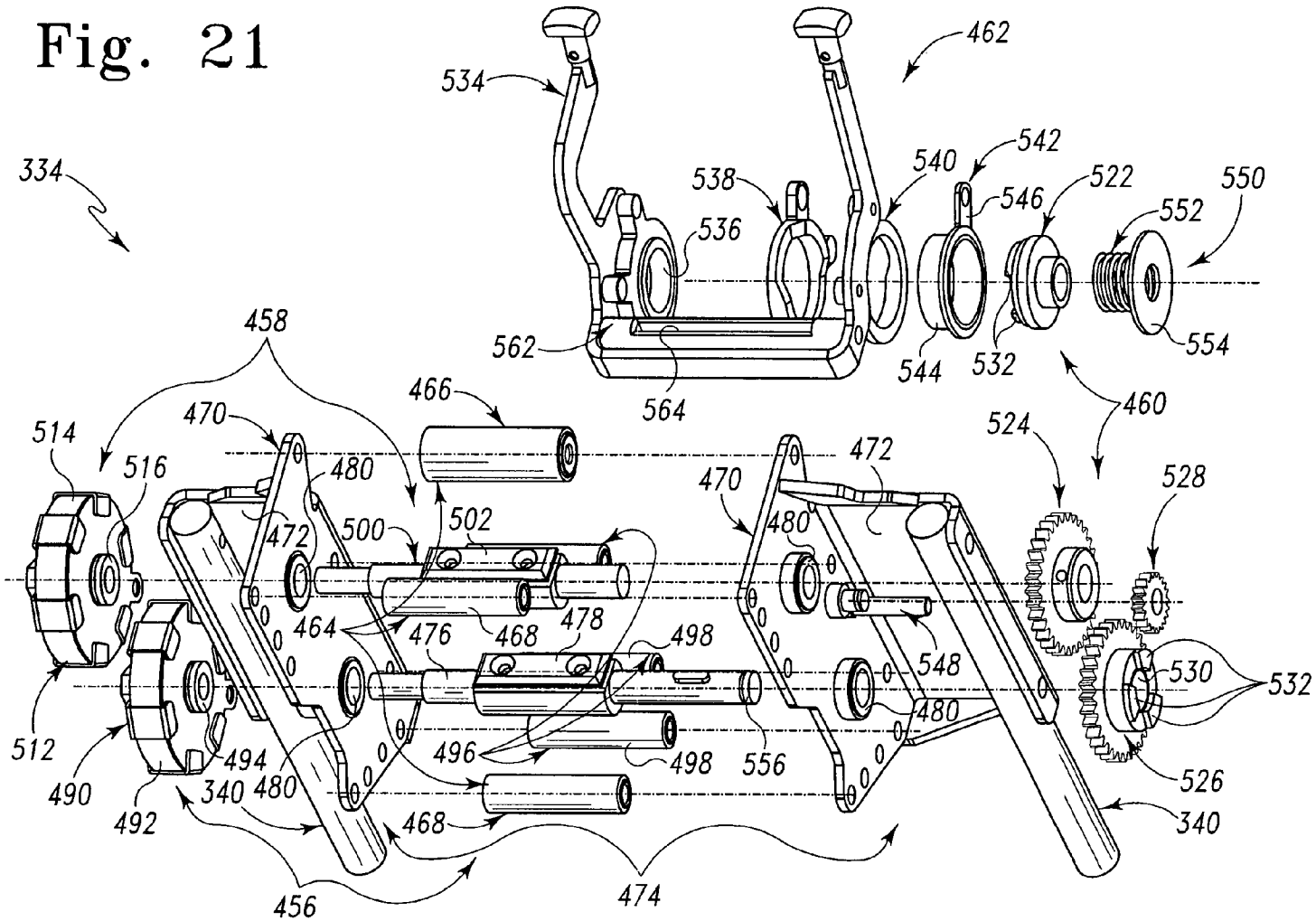
FIG. 21 is an exploded perspective view of a tether control unit of the apparatus of FIGS. 14 and 15.

The tether control unit 334 comprises spring biased first and second winders 456, 458, a clutch 460, and an actuator 462, as shown in FIG. 21. The first winder 456 is coupled to the first tether 326 to wind up and permit unwinding of the first tether 326 and is configured to maintain the first tether 326 taut during winding and unwinding thereof. The second winder 458 is coupled to the second tether 328 to wind up and permit unwinding of the second tether 328 and is configured to maintain the second tether 328 taut during winding and unwinding thereof.

The clutch 460 controls coupling and decoupling of the first and second winders 456, 458. In the tether coupling of operation, the clutch 460 is configured in an engaged state coupling the first and second winders 456, 458 together so that the first winder 456 winds up the first tether 326 to pull the sheet gripper 344, the sheet 332, and a patient positioned on the sheet 332 toward the head end 356 as the second tether 328 unwinds from the second winder 458 during raising of the patient-support portion 322 relative to the base portion 324. In the tether decoupling of operation, the clutch 460 is configured in a disengaged state decoupling the first and second winders 456, 458 from one another thereby permitting the first and second winders 456, 458 to operate independently from one another. The actuator 462 is configured to move the clutch 460 between its engaged and disengaged states. The first and second winders 456, 458, the clutch 460, and the actuator 462 are discussed in more detail herein.

The first winder 456 illustratively comprises a first roller assembly 464, as shown in FIG. 21. The first roller assembly 464 is configured to guide movement of the first tether 326 during winding and unwinding thereof. Illustratively, the first roller assembly 464 comprises a larger roller 466 and a pair of smaller rollers 468 about which the first tether 326 extends. The rollers 466, 468 are coupled to and extend between a pair of mounting plates 470. Each mounting plate 470 is coupled to a control unit mounting post 340 by a bracket 472 extending therebetween. Together, the mounting plates 470, mounting posts 340, and brackets 472 provide a mount 474 included in the tether control unit 334.

The first winder 456 illustratively comprises a rotatable first shaft 476 and a tether coupler 478, as shown in FIG. 21. Each end of the first shaft 476 is mounted in a bearing 480 that is coupled to a plate 470. The tether coupler 478 is configured to couple an end 482 of the first tether 326 to the first shaft 476. The first tether 326 winds around the shaft 476 when the shaft 476 is rotated about a rotation axis 484 in a tether-winding direction 486 and unwinds from the shaft 476 when the shaft 476 is rotated about the axis 484 in a tether-unwinding direction 488.

The first winder 456 further illustratively comprises a first tether tensioner 490 shown in FIGS. 21, 22, 24, 25, and 27 to bias the first shaft 476 in the tether-winding direction 486 to maintain the first tether 326 taut when the clutch 460 is in its disengaged state. The tensioner 490 comprises a spring (such as a rotary spring similar to biasing member 114 shown in FIG. 4) positioned inside of a spring housing 492 fixed to the mount 474. The spring is coupled to a sleeve 494 rotatably mounted in the spring housing 492. An end of the shaft 476 extends into and is fixed to the sleeve 494 so that the shaft 476 and the sleeve 494 rotate together. When the clutch 460 is moved to its disengaged state, the spring biases the sleeve 494 and the first shaft 476 in the tether-winding direction 486 to pull on the first tether 326 to maintain the first tether 326 taut.

The second winder 458 illustratively comprises a second roller assembly 496, as shown in FIG. 21. The second roller assembly 496 is configured to guide movement of the second tether 328 during winding and unwinding thereof. Illustratively, the second roller assembly 496 comprises three rollers 498 about which the second tether 328 extends. The rollers 496 are coupled to and extend between the mounting plates 470.

The second winder 458 further illustratively comprises a rotatable second shaft 500 and a tether coupler 502, as shown in FIG. 21. Each end of the second shaft 500 is mounted in a bearing 480 that is coupled to a plate 470. The tether coupler 502 is configured to couple an end 504 of the second tether 328 to the second shaft 500. The second tether 328 winds around the shaft 500 when the shaft 500 is rotated about a rotation axis 506 in a tether-winding direction 508 and unwinds from the shaft 500 when the shaft 500 is rotated about the axis 506 in a tether-unwinding direction 510.

The second winder 458 further illustratively comprises a second tether tensioner 512 shown in FIGS. 21, 22, 25, and 27 to bias the second shaft 476 in the tether-winding direction 508 to maintain the second tether 328 taut. The tensioner 512 comprises a spring (such as a rotary spring similar to biasing member 114 shown in FIG. 4) positioned inside of a spring housing 514 fixed to the mount 474. The spring is coupled to a sleeve 516 rotatably mounted in the spring housing 514. An end of the shaft 500 extends into and is fixed to the sleeve 516 so that the shaft 500 and the sleeve 516 rotate together. The spring biases the sleeve 516 and the second shaft 500 in the tether-winding direction 508 to pull on the second tether 328 (which has a stationary end 518 coupled to the base portion 324 by a tether coupler 520 shown in FIG. 14) to maintain the second tether 328 taut.

The clutch 460 illustratively comprises a set of gears and a clutch disc 522, as shown in FIG. 21. The set of gears comprises a drive gear 524, a driven gear 526, and an idler gear 528 mounted on an idler shaft 530 coupled to a mounting plate 470. The drive gear 524 is fixed to the second shaft 500 for rotation therewith about the axis 506 in response to unwinding and winding of the second tether 328 due to raising and lowering of the patient-support portion 322 relative to the base portion 324. Such rotation of the drive gear 524 is transmitted to the driven gear 526 through the idler gear 528. The driven gear 526 is rotatably mounted on the first shaft 476 by a bearing 530.

The clutch disc 522 is mounted on the first shaft 476 for axial movement along the axis 484 relative to the driven gear 526 between a first position associated with the engaged state of the clutch 460 and a second position associated with the disengaged state of the clutch 460. In the first position, lugs 532 on the clutch disc 522 engage lugs 532 on the driven gear 526 for transmission of rotation from the driven gear 526 to the first shaft 476 through the clutch disc 522, which is keyed to the first shaft 476, to wind or unwind the first tether 326. In the second position, the lugs 532 on the clutch disc 522 disengage the lugs 532 on the driven gear 526 to decouple rotation of the driven gear 526 from the first shaft 476. Illustratively, each of the driven gear 526 and the clutch disc 522 has three lugs.

The actuator 362 is configured to move the clutch disc 522 axially between its first and second positions. The actuator 362 illustratively comprises a handle 534 mounted for rotation about the axis 484 between a first handle position shown in FIGS. 22–24 and a second handle position shown in FIGS. 25, 26, and 27. The actuator 362 positions the clutch disc 522 in its first position and the clutch 460 in its engaged state when the handle 534 is positioned in its first handle position. The actuator 362 positions the clutch disc 522 in its second position and the clutch 460 in its disengaged state when the handle 534 is positioned in its second handle position.

The actuator 362 further illustratively comprises a bearing 536, a stationary cam 538, a cam follower 540, and a rotation transmission blocker 542, as shown in FIG. 21. The handle 534 is rotatably mounted to the first shaft 476 through the bearing 536 and is fixed to the cam follower 540 to rotate the cam follower 540 with the handle 534. The cam follower 540 is rotatably mounted on the rotation transmission blocker 542. The rotation transmission blocker 542 is mounted to block transmission of rotation of the handle 534 and cam follower 540 to the clutch disc 522. The blocker 542 comprises a ring 544 supported by one or both of the driven gear 526 and the clutch disc 522 and a flange 546 coupled to a mounting post 548 to block rotation of the ring 544.

When the handle 534 is positioned in its first handle position, the cam 538 and the cam follower 540 are positioned together to allow the lugs 532 on the driven gear 526 and clutch disc 522 to engage one another. A clutch disc biaser 550 biases the clutch disc 522 against the blocker 542 so that the lugs 532 on the clutch disc 522 engages the lugs 532 on the driven gear 526 through a channel provided by the cam 538, the cam follower 540, and the ring 544 of the blocker 542. Illustratively, the clutch disc biaser 550 comprising a coil spring 552 and a spring retainer 554. The coil spring 552 is positioned between the clutch disc 522 and the spring retainer 554 which mounted in a groove 556 formed in the first shaft 476.

Rotation of the handle 534 from its first handle position to its second handle position causes the cam follower 540 to rotate about the axis 484 against the stationary cam 538. The cam 538 is blocked against rotation with the cam follower 540 since it is coupled to the mounting post 548. In addition, engagement between the cam 538 and the driven gear 526 blocks axial movement of the cam 538 along the axis 484 when the cam follower 540 rotates against the cam 538.

Rotation of the cam follower 540 against the cam 538 causes the cam follower 538 to move axially away from the driven gear 526. Such axial movement of the cam follower 538 causes the blocker 542 and the clutch disc 522 engaging the blocker 542 to also move axially away from the driven gear 526. The lugs 532 on the driven gear 526 and clutch disc 522 disengage one another upon axial movement of the clutch disc 522 away from the driven gear 526, thereby establishing the second position of the clutch disc 522 and the disengaged state of the clutch 460.

To re-establish the engaged state of the clutch 460, the handle 534 is rotated from the second handle position back to the first handle position. During such handle rotation, the clutch disc biaser 550 pushes the clutch disc 522, the blocker 542, and the cam follower 540 axially back toward the driven gear 526 for re-engagement between the lugs 532 on the driven gear 526 and the clutch disc 522, thereby re-establishing the first position of the clutch disc 522 and the engaged state of the clutch 460.

The handle 534 is rotatable manually between the first and second handle positions for a user to select in which mode the tether control unit 334 is to operate. The handle 534 may also be rotated automatically from the first handle position to the second handle position to switch the tether control unit 334 from its tether coupling mode to its tether decoupling mode upon activation of a tether winding limiter 558.

Figure 22:
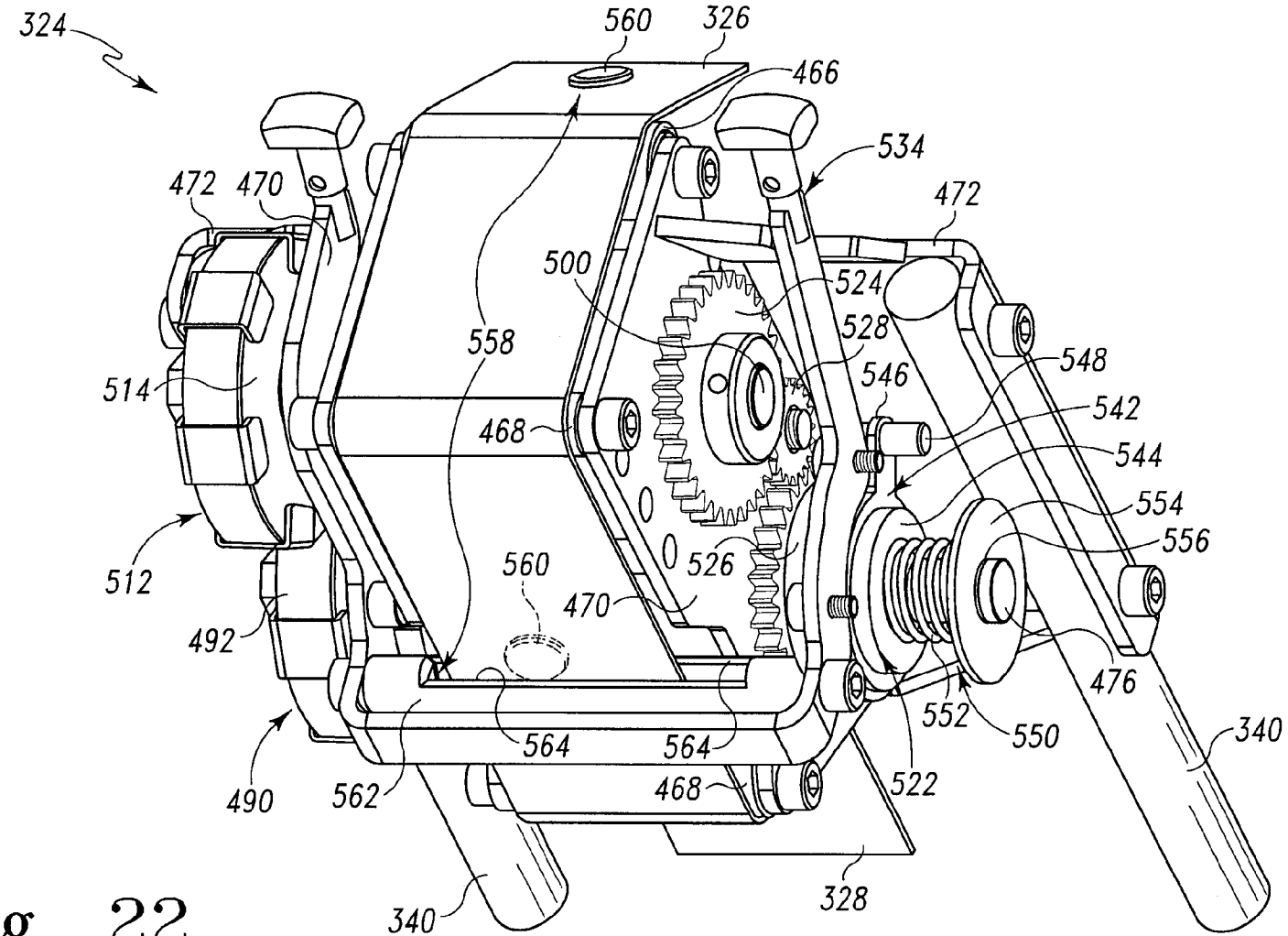
FIG. 22 is a perspective view showing the tether control unit in a tether coupling mode of operation to couple motion of first and second tethers together.
Figure 25:
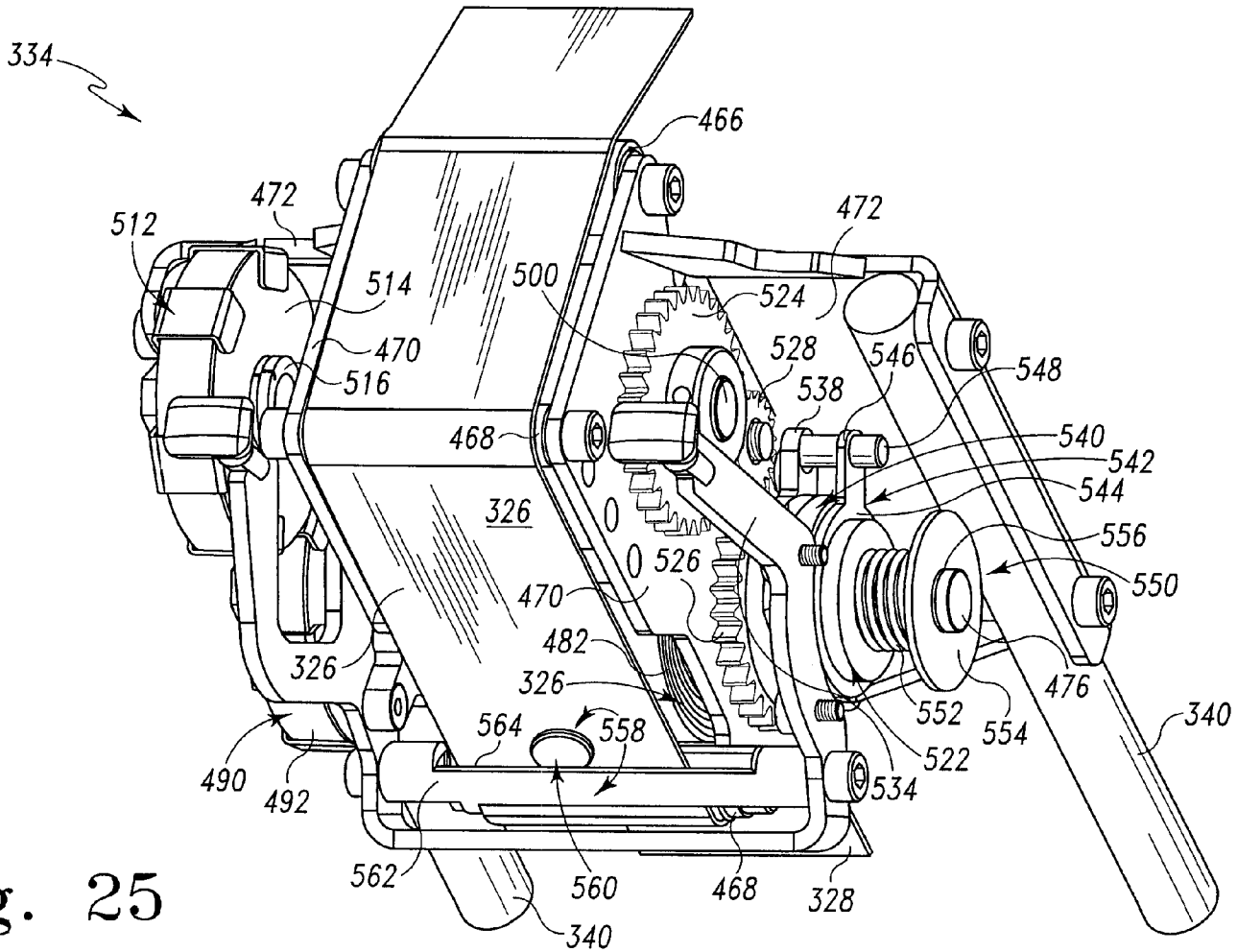
FIG. 25 is a perspective view showing the tether control unit in a tether decoupling mode of operation to decouple motion of the first and second tethers from one another.

The tether winding limiter 558 is configured to limit the extent to which the first winder 456 is permitted to wind up the first tether 326. The illustrative limiter 558 comprises a protuberance 560 and a slotted bar 562, as shown in FIGS. 22, 25, and 28. The protuberance 560 is fixed to the first tether 326 for movement therwith and the bar 562 is fixed to the handle 534 for movement therewith. The bar 562 comprises a slot 564 (see FIG. 28) that is wide enough to permit passage of the first tether 326 during winding and unwinding thereof but narrow enough to block passage of the protuberance 560. As such, if the first winder 456 winds up the first tether 326 a predetermined amount, the protuberance 560 will engage the slot 564. Such engagement between the protuberance 560 and the slot 564 causes the handle 534 to rotate from the first handle position to the second handle position as the first winder 456 continues to wind up the first tether 326. When the handle 534 reaches the second handle position, the first winder 456 is decoupled from the second winder 458, thereby ceasing further winding of the first tether 326 by the first winder 456.

It should be appreciated that a variety of flexible connecting members may be used for first and second tethers 326, 328, such as cords, lines, cables, chains, ties, straps, bands, belts, webs, or the like.

Although various apparatus and systems have been described in detail with reference to certain preferred or illustrative embodiments, variations and modifications of each of these apparatus and systems exist within the scope and spirit of the invention as described and defined in the following claims.

The invention claimed is:

1. A patient positioning apparatus for use with a patient-support device having a base portion and a patient-support portion which is movable upwardly and downwardly relative to the base portion and which includes a mattress with a sheet thereon, the patient positioning apparatus comprising a sheet gripper that is coupleable to the sheet, a first tether that pulls the sheet gripper toward an end of the patient support device in response to the patient-support portion of the bed being raised relative to the base portion, and a first winder that is spring biased to wrap up at least a portion of the first tether to maintain the first tether taut.

2. The patient positioning apparatus of claim 1, wherein the winder is coupled to the sheet gripper.

3. The patient positioning apparatus of claim 2, wherein the sheet gripper comprises a housing, at least one hook coupled to the housing, a bar around which the sheet is wrapped prior to the at least one hook being hooked around the bar and the sheet wrapped around the bar, and a second tether coupled to the housing and coupled to the bar.

4. The patient positioning apparatus of claim 3, wherein the at least one hook comprises a pair of hooks, the bar comprises a pair of opposite end portions around which the pair of hooks are hooked, and the bar comprises an enlarged central portion from which the pair of opposite end portions extend.

5. The patient positioning apparatus of claim 2, further comprising a ratchet assembly coupled to the winder, the ratchet assembly having a latched position in which the winder is permitted to wind in a first direction but is prevented from winding in a second direction which is opposite to the first direction, and the ratchet assembly has an unlatched position in which the winder is permitted to wind in the first and second directions.

6. The patient positioning apparatus of claim 5, wherein the sheet gripper comprises a housing in which the ratchet assembly and the winder are positioned and a handle that is accessible outside the housing and that is movable to move the ratchet assembly between the latched and unlatched positions.

7. The patient positioning apparatus of claim 2, wherein the first tether has a first end and a second end, the first end is coupled to the winder, and the second end is coupled to the base portion of the patient-support device.

8. The patient positioning apparatus of claim 7, wherein the winder winds up the tether when the patient-support portion of the patient-support device is lowered toward the base portion and further comprising means for preventing the tether from unwinding from the winder when the patient-support portion is raised relative to the base portion.

9. The patient positioning apparatus of claim 8, wherein the preventing means comprises a ratchet assembly.

10. The patient positioning apparatus of claim 1, further comprising a second tether and a second winder that maintains the second tether taut, the first tether has a first end coupled to the sheet gripper and a second end coupled to the first winder, and the second tether has a first end to be coupled to the base portion of the patient-support device and a second end to be coupled to the second winder.

11. The patient positioning apparatus of claim 10, further comprising a mount to which both the first and second winders are coupled.

12. The patient positioning apparatus of claim 11, wherein the mount is to be coupled to the patient-support portion to be raised and lowered therewith.

13. The patient positioning apparatus of claim 10, further comprising a clutch coupled to the first and second winders, the clutch having an engaged state in which unwinding of the second tether from the second winder due to raising the patient-support portion relative to the base portion results in the first winder winding up the first tether to pull the sheet gripper toward the end of the patient-support portion, and the clutch having a disengaged state in which the first and second winders are decoupled and operate independently.

14. The patient positioning apparatus of claim 13, wherein the first winder comprises a first rotatable shaft and the second winder comprises a second rotatable shaft, the clutch comprises a set of gears including a first gear mounted on the first shaft and a second gear fixed to the second shaft to rotate with the second shaft, the first gear has at least one first lug, the clutch comprises a clutch disc coupled to the first shaft for axial movement therealong between a first position and a second position, the clutch disc is keyed to the first shaft to rotate therewith, the clutch disc has at least one second lug, the second lug engages the at least one first lug when the clutch disc is in the first position so that rotation of the first gear is transmitted to the first shaft through the clutch disc, and the at least one second lug is spaced from the at least one first lug when the clutch is in the disengaged state so that the first gear and first shaft are rotatable independently.

15. The patient positioning apparatus of claim 14, further comprising a handle that is coupled to the clutch and that is movable between a first handle position in which the clutch disc is in the first position and a second handle position in which the clutch is in the second position.

16. The patient positioning apparatus of claim 1, wherein the sheet gripper comprises an arm, a roller coupled to the arm, and a ratchet assembly coupled to the arm and to the roller, the ratchet assembly having an engaged state and a disengaged state; when the ratchet assembly is in the engaged state, the roller is permitted to spin relative to the arm in a first direction to allow the sheet to be wrapped around the roller and the roller is prevented by the ratchet assembly from spinning in a second direction opposite to the first direction; and when the ratchet assembly is in the disengaged state the roller is permitted to spin in the first and second directions.

17. The patient positioning apparatus of claim 16, wherein the sheet gripper comprises a manual release that is coupled to the arm and that is engageable to move the ratchet assembly from the engaged state to the disengaged state.

18. A patient-support device comprising:

a base portion, a patient-support portion movable between a raised position and a lowered position relative to the base portion, a sheet situated on the patient-support portion, a patient positioning apparatus comprising a sheet gripper releasably coupleable to the sheet, a tether control unit, a first tether, and a second tether, the tether control unit having a first winder and a second winder, the first tether being coupled to the sheet gripper and the first winder, the second tether being coupled to the sheet gripper and the base portion, the first winder being spring biased to maintain the first tether taut, and the second winder being spring biased to maintain the second tether taut.

19. The patient-support device of claim 18, wherein the patient-support portion comprises a headboard and the tether control unit is coupled to the headboard.

20. The patient-support device of claim 18, wherein the tether control unit comprises a clutch coupled to the first and second winders, the clutch having an engaged state and a disengaged state, and when the clutch is in the engaged state, unwinding of the second tether from the second winder due to raising of the patient-support portion relative to the base portion results in the first winder winding up the first tether to pull the sheet gripper toward the tether control unit.

21. A patient positioning apparatus for use with a patient-support device having a base portion and a patient-support portion which is movable upwardly and downwardly relative to the base portion and which includes a mattress with a sheet thereon, the patient positioning apparatus comprising a sheet gripper that is coupleable to the sheet, a first tether that pulls the sheet gripper toward an end of the patient support device in response to the patient-support portion of the bed being raised relative to the base portion, a first winder to wrap up at least a portion of the first tether, and a ratchet assembly coupled to the winder, the ratchet assembly having a latched position in which the winder is permitted to wind in a first direction but is prevented from winding in a second direction which is opposite to the first direction and an unlatched position in which the winder is permitted to wind in the first and second directions.

22. The patient positioning apparatus of claim 21, wherein the sheet gripper comprises a housing in which the ratchet assembly and the winder are positioned and a handle that is accessible outside the housing and that is movable to move the ratchet assembly between the latched and unlatched positions.

23. A patient positioning apparatus for use with a patient-support device having a base portion and a patient-support portion which is movable upwardly and downwardly relative to the base portion and which includes a mattress with a sheet thereon, the patient positioning apparatus comprising a sheet gripper to be coupled to the sheet, first and second tethers, and a tether control unit to be mounted to the patient-support portion for movement therewith, the first tether being coupled to the sheet gripper and the tether control unit, the second tether being coupled to the tether control unit and configured to be coupled to the base portion, the tether control unit having a tether coupling mode of operation in which motion of the second tether due to raising of the patient-support portion relative to the base portion causes motion of the first tether to move the sheet gripper toward an end of the patient-support portion and a tether decoupling mode of operation in which motion of the second tether due to lowering of the patient-support portion relative to the base portion does not cause motion of the first tether.

24. The patient positioning apparatus of claim 23, wherein the tether control unit comprises a first winder to wind up the first tether, a second winder to wind up the second tether, and a clutch having an engaged state in which the first winder winds up the first tether when the second winder unwinds the second tether due to raising of the patient-support portion relative to the base portion and a disengaged state in which the first winder neither winds nor unwinds the first tether when the second winder winds up the second tether due to lowering of the patient-support portion relative to the base portion.

25. The patient positioning apparatus of claim 24, wherein the tether control unit comprises an actuator to move the clutch between its engaged and disengaged states.

26. The patient positioning apparatus of claim 25, wherein the actuator comprises a cam and a cam follower to follow the cam to move the clutch from its engaged state to its disengaged state.

* * * * *